US007709170B2

(12) United States Patent
Kami

(10) Patent No.: US 7,709,170 B2
(45) Date of Patent: May 4, 2010

(54) LATENT ELECTROSTATIC IMAGE BEARING MEMBER, AND PROCESS CARTRIDGE, IMAGE FORMING APPARATUS AND IMAGE FORMING METHOD

(75) Inventor: Hidetoshi Kami, Numazu (JP)

(73) Assignee: Ricoh Company, Ltd., Tokyo (JP)

( * ) Notice: Subject to any disclaimer, the term of this patent is extended or adjusted under 35 U.S.C. 154(b) by 933 days.

(21) Appl. No.: 11/472,231

(22) Filed: Jun. 20, 2006

(65) Prior Publication Data

US 2006/0286473 A1 Dec. 21, 2006

(30) Foreign Application Priority Data

Jun. 20, 2005 (JP) ..... 2005-178924

(51) Int. Cl.
*G03G 5/047* (2006.01)

(52) U.S. Cl. ..... 430/58.85; 430/58.65; 430/58.7; 430/58.75; 399/159

(58) Field of Classification Search ..... 430/58.85, 430/58.65, 58.7, 58.75; 399/159
See application file for complete search history.

(56) References Cited

U.S. PATENT DOCUMENTS

| | | | | |
|---|---|---|---|---|
| 5,871,876 | A | 2/1999 | Ikuno et al. | |
| 6,030,733 | A | 2/2000 | Kami et al. | |
| 6,151,468 | A | 11/2000 | Kami et al. | |
| 6,326,112 | B1 | 12/2001 | Tamura et al. | |
| 6,573,016 | B2 | 6/2003 | Kami et al. | |
| 6,641,964 | B2 | 11/2003 | Ikuno et al. | |
| 6,653,033 | B1 | 11/2003 | Kami et al. | |
| 6,790,572 | B2 | 9/2004 | Tamoto et al. | |
| 6,844,124 | B2 | 1/2005 | Ikuno et al. | |
| 6,858,362 | B2 | 2/2005 | Tamoto et al. | |
| 6,861,188 | B2 | 3/2005 | Ikegami et al. | |
| 6,879,799 | B2 | 4/2005 | Nohsho et al. | |
| 6,936,388 | B2 | 8/2005 | Suzuki et al. | |
| 2003/0113642 | A1 | 6/2003 | Kami et al. | |
| 2003/0118372 | A1 * | 6/2003 | Kitano et al. | 399/176 |
| 2004/0126687 | A1 | 7/2004 | Ikegami et al. | |
| 2004/0185358 | A1 | 9/2004 | Kami | |
| 2004/0197688 | A1 | 10/2004 | Tamoto et al. | |
| 2004/0234294 | A1 | 11/2004 | Nagame et al. | |
| 2005/0008957 | A1 | 1/2005 | Ikegami et al. | |

(Continued)

FOREIGN PATENT DOCUMENTS

| | | |
|---|---|---|
| JP | 06-118681 | 4/1994 |

(Continued)

OTHER PUBLICATIONS

Diamond, Handook of Imaging Materials, Marcel Dekker, NY, NY 1991. pp. 398-399.*

*Primary Examiner*—Mark F Huff
*Assistant Examiner*—Peter L Vajda
(74) *Attorney, Agent, or Firm*—Cooper & Dunham LLP

(57) ABSTRACT

A latent electrostatic image bearing member including at least a support, a photoconductive layer on the support and a surface layer on the photoconductive layer, wherein a film having the same composition as the surface layer is formed on a slide glass such that the film had a thickness of 5 μm; and the haze value measured after rubbing the film with a steel wool of #000 and a load of 500 gf for 50 times is 10% or less.

14 Claims, 8 Drawing Sheets

U.S. PATENT DOCUMENTS

| | | | |
|---|---|---|---|
| 2005/0026058 | A1 | 2/2005 | Kami et al. |
| 2005/0053853 | A1 | 3/2005 | Sugino et al. |
| 2005/0079433 | A1 | 4/2005 | Watanabe et al. |
| 2005/0100804 | A1 | 5/2005 | Tamoto et al. |
| 2005/0106482 | A1 | 5/2005 | Kami et al. |
| 2005/0118518 | A1 | 6/2005 | Ikegami et al. |
| 2005/0141919 | A1 | 6/2005 | Kitajima et al. |
| 2005/0158644 | A1 | 7/2005 | Kondo et al. |
| 2005/0170272 | A1 | 8/2005 | Suzuki et al. |
| 2005/0181291 | A1 | 8/2005 | Kami et al. |
| 2005/0233235 | A1* | 10/2005 | Qi et al. ..... 430/66 |

FOREIGN PATENT DOCUMENTS

| | | |
|---|---|---|
| JP | 09-124943 | 5/1997 |
| JP | 09-190004 | 7/1997 |
| JP | 2000-171990 | 6/2000 |

* cited by examiner

LATENT ELECTROSTATIC IMAGE BEARING MEMBER, AND PROCESS CARTRIDGE, IMAGE FORMING APPARATUS AND IMAGE FORMING METHOD

BACKGROUND

1. Technical Field

This disclosure relates to: a latent electrostatic image bearing member used for a photocopier, a Facsimile, a laser printer and a direct digital plate maker, which is hereinafter referred to also as a photoconductor or an electrophotographic photoconductor; and a process cartridge, an image forming method and an image forming apparatus which uses thereof.

2. Description of the Related Art

Over ten years have passed since a plan of action 'Agenda 21' established with hope for handing the rich global environment on to the next generation was adopted, and public awareness towards the environmental conservation has considerably deepened. For example, separation of recyclables from non-recyclables and frequent use of the blank sides of used sheets of paper as printer sheets are examples of immediate change in awareness. Today, the environmental performance of an industrial product has been generally emphasized such that it influences the future of the product. Under such circumstance, the usage pattern of a photoconductor still has a strong aspect as a disposable supply product, and the situation is such that the impact on the global environment cannot be accepted. In response to this, it is required to suppress the abrasion and scratches on a photoconductor in view aspects of design and usage of the photoconductor. At the same time, the damage to the contacting members disposed around the photoconductor should be reduced. Once these are achieved, it becomes possible to suppress the temporal degradation of an image forming engine. As a result, the frequency of component replacement as well as the replacement of the apparatus itself may be reduced, which can contribute to the reduction of environmental burdens such as resource saving and prevention of air pollution.

An amorphous silicone photoconductor is a typical heavy-duty photoconductor today. The production cost of the amorphous silicone photoconductor is high since the manufacturing method thereof is a dry process, and it is used only for high-end apparatuses with some exceptions. The contribution of the high durability of the amorphous silicone conductor to the reduction of environmental burdens is considered insufficient since the use ratio of the amorphous silicone conductor is small. In order to achieve the reduction of environmental burdens, it is desirable that the durability of the photoconductor is enhanced as well as the cost is reduced to increase the usage ratio. To achieve this, it is advantageous to increase the durability of a low-cost organic photoconductor (OPC).

When an abrasion resistance of a metal is given to the organic photoconductor, the abrasion resistance equivalent to the increase in the abrasion resistance is required. When the surface of the photoconductor is scratched, the electrical discharge hazard in an electrophotographic process concentrates in and alters the scratched portions. Also, grooves formed by the scratches are embedded with a toner component or paper powder, and thus, local image deficiencies such as background smear and blur tend to occur. As the abrasion resistance further improves, a scratch once occurred cannot easily disappear with time as if it is engraved. As a result, the scratches inhibit the longer operating life of the photoconductor.

Therefore, an improvement of the operating life of a photoconductor by means of a reduction of the abrasion in the photoconductive layer has been examined, and various proposals thereof have been made. For example, Japanese Patent Application Laid-Open (JP-A) No. 06-118681 proposes the use of a curable silicone resin including colloidal silica as a surface protective layer of a photoconductor.

Also, JP-A Nos. 09-124943 and 09-190004 propose a photoconductor whose surface includes on its surface a resin layer in which an organosilicon modified hole transport compound is bound in a curable organosilicon polymer.

In addition, JP-A 2000-171990 proposes a method for manufacturing a photoconductor in which a curable siloxane resin including a functional group which imparts an electron transport property is cured in a three-dimensional network.

However, these proposals are likely to encounter problems such as reduction of the adhesion to a material and occurrences of a crack due to the use of rigid monomer for enhanced hardness and the increase of the distortion during cure time for enhanced crosslink density. Also, it is extremely difficult to resolve an issue specific to an electrophotography that a scratch is engraved even on a hard surface such as amorphous silicone once a very hard material such as developer carrier is adhered and rubbed on the conductor surface. When a photoconductor having a high surface hardness is used, it is restricted to use a developer carrier having an extremely large particle diameter or to employ a one-component developing method so that the carrier adhesion is avoided. Furthermore, for the improvement of abrasion resistance, it is considered advantageous to improve the stress relaxation rather than to enhance the surface hardness.

So far, no effective solutions have been proposed to improve the durability for scratches of a latent electrostatic image bearing member. Therefore, a latent electrostatic image bearing member is protected with excessive packaging materials so that no scratches are made on the surface of the latent electrostatic image bearing member, and it is currently not given a status as a product which anybody can handle with ease.

SUMMARY

In an aspect of this disclosure, there is provided a latent electrostatic image bearing member as well as a process cartridge, an image forming method mid an image forming apparatus which uses the latent electrostatic image bearing member, wherein the latent electrostatic image bearing member requires simplified protective materials and packaging material for storage and transport; the latent electrostatic image bearing member may be handled by anybody with ease; an abnormal image caused by a scratch on the surface of the latent electrostatic image bearing member may be prevented from occurring; and the latent electrostatic image bearing member has a strong resistance to foreign particles so that carrier with small particle diameter may be used and has a superior self-repairing function.

The above-mentioned latent electrostatic image bearing member includes a surface layer formed by applying to its surface a coating solution with high resilience such as self-repairing coating. Even though the latent electrostatic image bearing member is scratched, a scratched portion is restored, and the coating film on the surface is regenerated. Therefore, a scratch on the latent electrostatic image bearing member does not last, and as a result, it becomes more resistant to scratches. Moreover, the formation is easy with less cost since the surface layer is formed by applying a coating solution.

Here, the self-repairing function is a function to repair some abrasions or pressure dents, which temporarily exist as scratches relative to other flat surfaces, with time by means of the resilience of the coating solution so that the scratches subside.

The self-repairing coating has a longer functional side chain, i.e. chain between a cross-linking point and an acrylic main chain, compared to an ordinary acrylic resin coating. This indicates that the self-repairing coating has a structure with high mechanical flexibility of the side chain of the self-repairing coating and therefore the cross-linking portion with the acrylic main chain. Thus, this long side chain works as a spring with respect to an external pressure and achieves a self-repairing function by means of resilience. The self-repairing coating usually has a higher surface lubricity and a lower surface friction factor than an ordinary coating film. Therefore, the surface becomes slippery even though it collides with a hard material; an external force is distributed more in a direction parallel with the coating film, and a force in a direction perpendicular to the coating film is reduced. As a result, the coating film itself becomes prone to scratches.

In order to develop the self-repairing function on the surface of the latent electrostatic image bearing member, it is advantageous that a resin layer forming the surface layer has a network structure which functions as a spring. It is preferable that the resin layer as the surface layer has a cross-linking structure and that the cross-linking structure further has a soft segment and a hard segment. The soft segment alone has a weaker resilience, and it is difficult to maintain the shape. The hard segment alone is inappropriate since a scratch is engraved. The soft segment is preferably polycaprolactone, and for the hard segment, urethanes or melamines are preferably used as a curing agent.

On the other hand, the latent electrostatic image bearing member should have basic functions as a latent electrostatic image bearing member. More specifically, it is required to ensure sufficient light attenuation with exposure to obtain a printed image with high contrast. In order to secure sufficient light attenuation, it is advantageous to formulate a conductive filler for the purpose of providing a charge injection property from the conductor surface. Also, it is preferable to provide a charge injection property from the lower layer and a charge transport property in the surface layer by introducing a charge transport segment in the cross-linked resin layer. In this case, the quality of the photoconductor itself if degraded if these additives become trapping sites of charges or cause a defective curing, so such deficiencies are preferably prevented.

For a case with the formulation of a conductive filler, the resistance of the surface layer preferably has about two digits less compared to the resistance of the lower layer. Also, since the loss of transparency due to the formulation of a conductive filler causes insufficient charge generation by means of exposure, the formulated filler is preferably transparent even after film formation. More specifically, tin oxide is preferably used as a conductive filler. The resistance of the surface layer may be controlled with the configuration of the resistance, formulated amount and thickness configuration of the conductive filler.

When a cross-linking charge transport material is included in the surface is layer, the ionization potential of the charge transport component after curing should be equivalent or less than that of the charge transport material in the lower layer for the ease where the charge carrier is a hole. This is reversed for the case where the charge charier is an electron. Furthermore, the difference in the ionization potential of the charge transport material included in the lower layer and the uncured charge transport component are desirably small. This is because either charge transport component acts as a trapping site. More specifically, the combination preferably has the difference of 0.1 eV or less. Preferable charge transport components are the following compounds for the necessity of ensuring a sufficient sport performance.

Furthermore, during the formation of a surface layer having a self-repairing function, components in the lower layer may be dissolved and mixed in the surface layer, and they often act as a trapping site. Therefore, the solvent used for the formation of the surface layer is preferably a compound which does not dissolve the lower layer. Although it depends on the film deposition method, a solvent preferably has a solubility of 1 L/10 mg or greater.

In another aspect of this disclosure, there is provided an image forming apparatus that includes at least: a latent electrostatic image bearing member; a latent electrostatic image forming unit which forms a latent electrostatic image on the latent electrostatic image bearing member; a developing unit which forms a visible image by developing the latent electrostatic image with a toner; a transferring unit which transfers the visible image to a recording medium; and a fixing unit which fixes a transfer image transferred to the recording medium, and the latent electrostatic image bearing member is the latent electrostatic image bearing member of the present invention. As a result, a favorable image may be stably formed over a long period of time.

In another aspect of this disclosure, there is provided an image forming method that includes at least: a latent electrostatic image forming process which forms a latent electrostatic image on a latent electrostatic image bearing member; a developing process which forms a visible image by developing the latent electrostatic image with a toner; a transferring process which transfers the visible image to a recording medium; and a fixing process which fixes a transfer image transferred to the recording medium, and the latent electrostatic image bearing member is the latent electrostatic image bearing member of the present invention. As a result, a favorable image may be stably formed over a long period of time.

In another aspect of this disclosure, there is provided a process cartridge that includes the following as a unit: a latent electrostatic image hearing member, and at least one unit selected from a charging unit, a developing unit, a transferring unit and a cleaning unit. Such a process cartridge has superior convenience and can stably provide a favorable image over a long period or time.

BREIF DESCRIPTION OF THE DRAWINGS

DESCRIPTION OF THE PREFERRED EMBODIMENTS (Latent Electrostatic Image Bearing Member)

A latent electrostatic image bearing member includes a support, a photoconductive layer on the support and a surface layer on the photoconductive layer, and it further includes other layers according to requirements.

The latent electrostatic image bearing member has a superior self-repairing function. Regarding this self-repairing function, a film having the same composition as the surface layer in the latent electrostatic image bearing member and a thickness of 5 μm or less is formed, and the haze value measured after rubbing the film with a steel wool of #000 and a load of 500 gf is by necessity 10% or less, preferably 1.0% or less, and more preferably 0.5% or less. The haze value exceeding 10% may result in an insufficient self-repairing function.

Here, the haze value may be measured with a commercially available haze meter, for example.

The latent electrostatic image bearing member in a first aspect includes a support, a single-layer photoconductive layer on the support and a surface layer on the single-layer photoconductive layer, and it further includes other layers according to requirements.

The latent electrostatic image bearing member in a second aspect includes: a support; a laminated photoconductive layer which includes on the support at least a charge generating layer and a charge transport layer in this order; and a surface layer on the laminated photoconductive layer, and it further includes other layers according to requirements. In the second aspect, the charge generating layer and the charge transport layer may be laminated in a reverse order.

Figure 1:
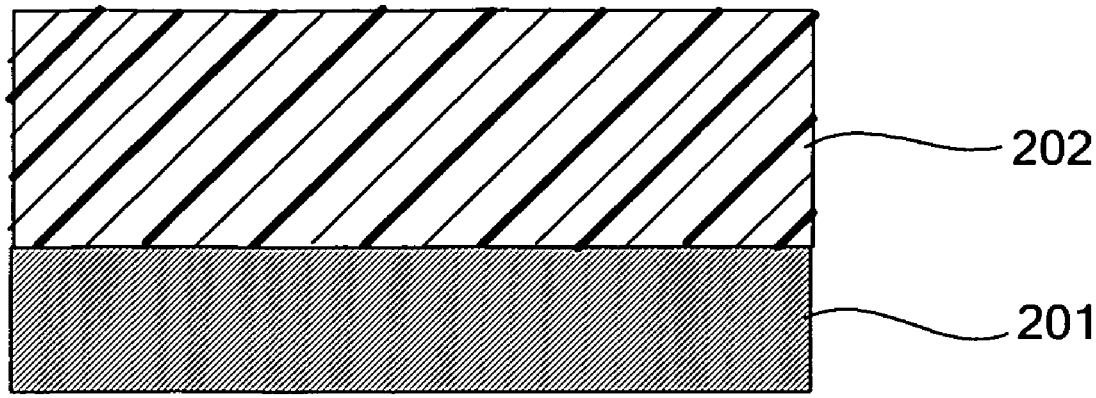
FIG. 1 is a cross-sectional diagram schematically showing an example of a layer composition of a latent electrostatic image bearing member of the present invention.

FIG. 1 is a cross-sectional diagram schematically showing an example of a layer composition of a latent electrostatic image bearing member of the present invention, and it has a structure in which a photoconductive layer 202 is disposed on a support 201.

Also, FIGS. 2 to 5 are cross-sectional diagrams schematically showing other examples of a layer composition of a latent electrostatic image bearing member of the present invention.

Figure 2:
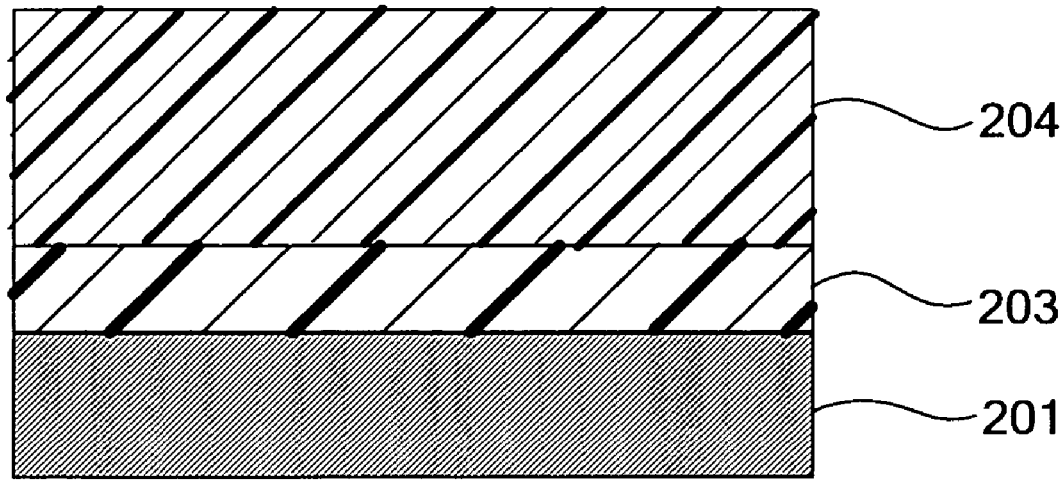
FIG. 2 is a cross-sectional diagram schematically showing another example of a layer composition of a latent electrostatic image bearing member of the present invention.
Figure 3:
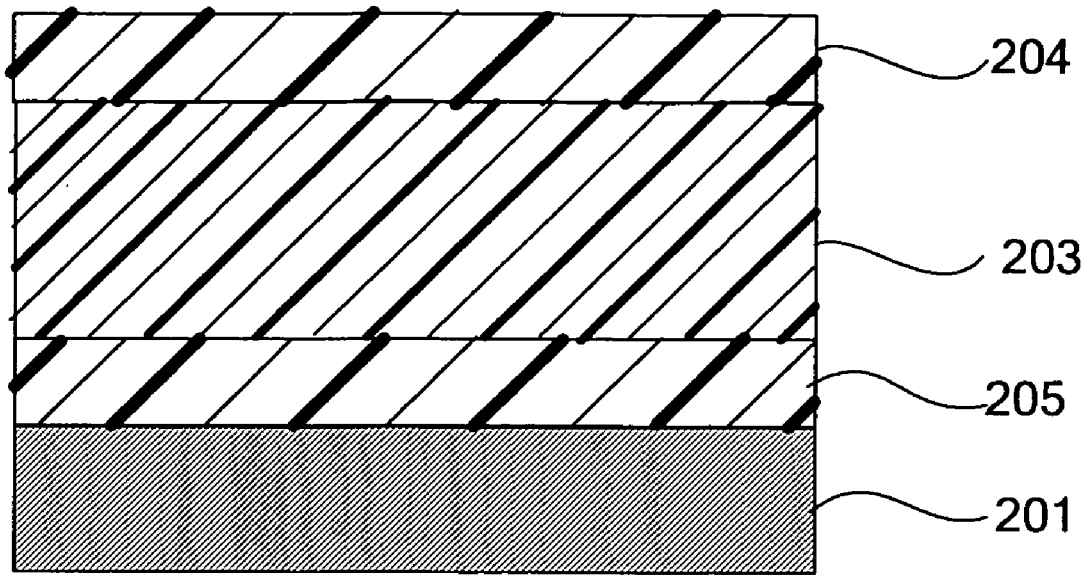
FIG. 3 is a cross-sectional diagram schematically showing yet another example of a layer composition of a latent electrostatic image bearing member of the present invention.
Figure 4:
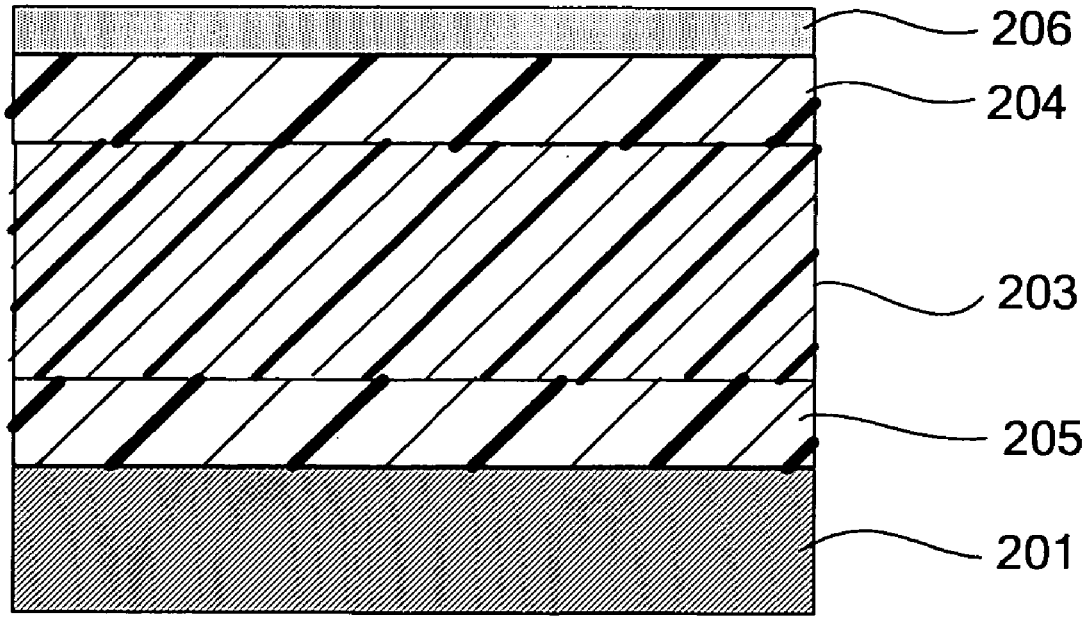
FIG. 4 is a cross-sectional diagram schematically showing yet another example of a layer composition of a latent electrostatic image bearing member of the present invention.
Figure 5:
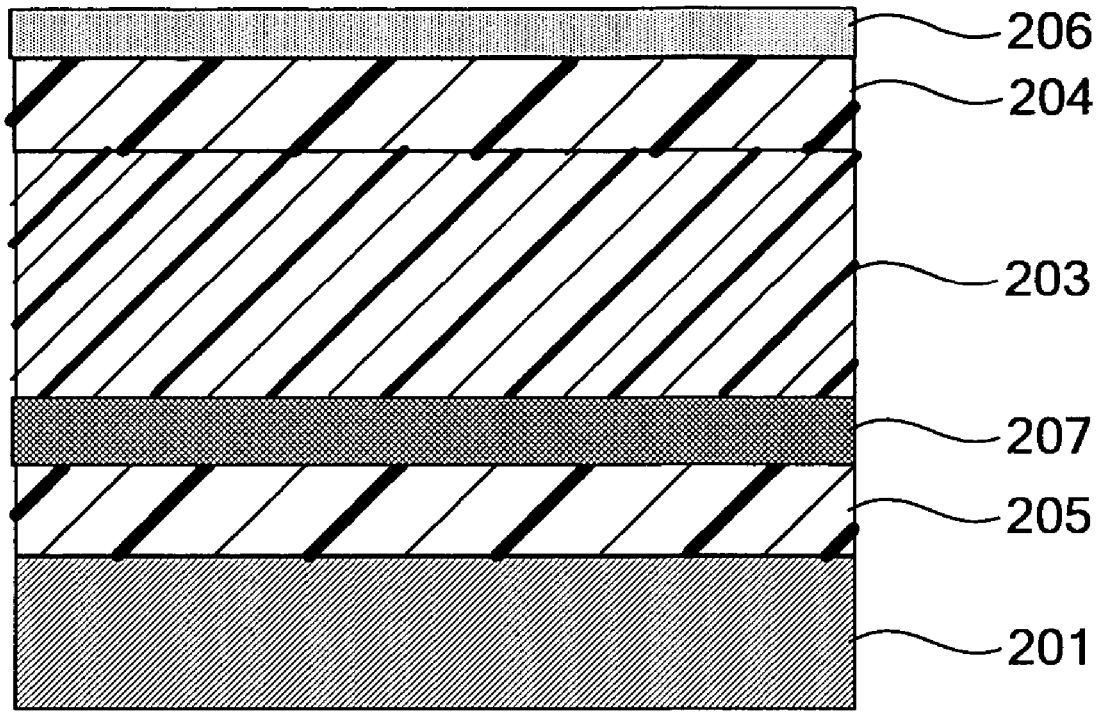
FIG. 5 is a cross-sectional diagram schematically showing yet another example of a layer composition of a latent electrostatic image bearing member of the present invention.

FIG. 2 is a separated-function photoconductor which is composed of a charge generating layer (CGL) 203 and a charge transport layer (CTL) 204. FIG. 3 is a type of photoconductor in which an undercoat layer 205 is disposed between the support 201 and the charge generating layer (CGL) 203 of the separated-function photoconductor. FIG. 4 is a type of photoconductor in which a surface layer 206 is laminated over the charge transport layer 204. FIG. 5 is a type of photoconductor in which an intermediate layer 207 is disposed between the undercoat layer 205 and the charge generating layer 203. A latent electrostatic image bearing member of the present invention may include the other layers and the types of the photoconductors with arbitrary combination as long as it at least includes the photoconductive layer 202 on the support 201.

<Surface Layer>

The surface layer has a superior self-repairing function as mentioned above. It includes at least any one of (1) a cured material of a composition including a polydimethylsiloxane copolymer, a polycaprolactone and a polysiloxane, and (2) a cured material of a polydimethylsiloxane copolymer to which a polycaprolactone and a polysiloxane are introduced in the skeleton, and it further includes other components according to requirements.

The composition (1) includes cases where (i) a polydimethylsiloxane copolymer, polycaprolactone and polysiloxane are independent constituents of the composition, (ii) a polydimethylsiloxane copolymer in which polycaprolactone is introduced in the skeleton and polysiloxane are constituents of the composition, and (ii) a polydimethylsiloxane copolymer in which polysiloxane is introduced in the skeleton and polycaprolactone are constituents of the composition. The respective compositions may be used alone or in combination of two or more.

Also, (2) the polycaprolactone and the polydimethylsiloxane copolymer in which polysiloxane is introduced in the skeleton may be used alone or in combination with one type or two or more types of the composition of (1) above.

As the composition of (1) above or the polydimethylsiloxane copolymer of (2) above, an appropriately synthesized material may be used, or a commercial product may be used.

Favorable examples of the commercial product include SELF-REPAIRING CLEAR No. 100, a trade name of Natoco Co., Ltd.

—Polydimethylsiloxane Copolymer—

The polydimethylsiloxane copolymer is a copolymer including a polydimethylsiloxane moiety and a polymer chain moiety of a vinyl monomer, and it may be a block copolymer or a graft copolymer.

The polydimethylsiloxane block copolymer may be synthesized with a living polymerization method, a macroinitiator method or a polymer chain transfer method.

Regarding the macroinitiator method, for example, an efficient synthesis of a block copolymer is possible through a copolymerization with a vinyl monomer by means of an azo free-radical polymerization initiator. Also, a two-step polymerization is possible first by copolymerizing a peroxy monomer and a polydimethylsiloxane including an unsaturated group at a low temperature to synthesize a prepolymer with which a peroxide radical is introduced to its side chain and then by copolymerizing the prepolymer with a vinyl monomer.

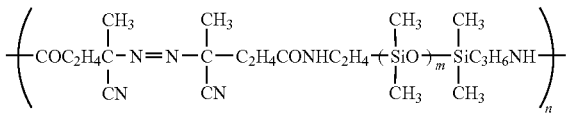

In the above structural formula, m represents an integer of 10 to 300; and n represents an integer of one to 50.

Regarding the polymer chain transfer method, for example, a silicone oil represented by the structural formula below is added with HS—$CH_2$COOH or HS—$CH_2CH_2COOH$ to form a silicone compound having an SH group, and a block copolymer may be synthesized through a polymerization of the silicone compound and a vinyl monomer by means of the chain transfer of the SH radical.

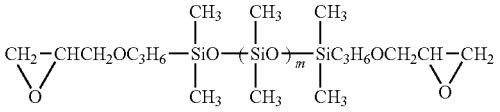

In the above structural formula, m represents an integer of 10 to 300.

Regarding the polydimethylsiloxane graft copolymer, a graft copolymer may be easily and efficiently synthesized through a copolymerization of methacrylic ester of polydimethylsiloxane represented by the structural formula below with a vinyl monomer.

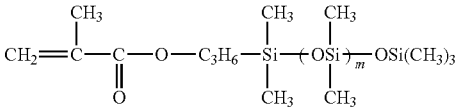

In the above structural formula, m represents an integer of 10 to 300.

The vinyl monomer used for the copolymerization with a polydimethylsiloxane is not particularly restricted and can be appropriately selected according to applications. Examples thereof include methyl acrylate, ethyl acrylate, n-butyl acrylate, isobutyl acrylate, octyl acrylate, cyclohexyl acrylate, tetrahydrofurfuryl acrylate, methyl methacrylate, ethyl methacrylate, n-butyl methacrylate, isobutyl methacrylate, 2-ethylhexyl methacrylate, stearyl methacrylate, lauryl methacrylate, methyl vinyl ether, ethyl vinyl ether, n-propyl vinyl ether, n-butyl vinyl ether, isobutyl vinyl ether, styrene, α-methylstyrene, acrylonitrile, methacrylonitrile, vinyl acetate, vinyl chloride, vinylidene chloride, vinyl fluoride, vinylidene fluoride, glycidyl acrylate, glycidyl methacrylate, aryl glycidyl ether, acrylic acid, methacrylic acid, itaconic acid, crotonic acid, maleic acid, maleic anhydride, citraconic acid, acrylamide, methacrylamide, N-methylolacrylamide, N,N-dimethylacrylamide, N,N-dimethylaminoethylmethacrylate, N,N-diethylaminoethylmethacrylate and diacetone acrylamide.

In addition, a vinyl monomer including an OH group such as 2-hydroxyethyl acrylate, 2-hydroxyethyl methacrylate, 2-hydroxypropyl acrylate, 2-hydroxypropyl methacrylate and aryl alcohol may also be used. Moreover, a product of Cardura E, manufactured by Hexion Specialty Chemicals, with acrylic acid, methacrylic acid, itaconic acid, crotonic acid or maleic acid may also be used.

—Polycaprolactone—

Examples of the polycaprolactone include bifunctional polycaprolactone diols represented by Structural Formula (i) below, trifunctional polycaprolactone triols represented by Structural Formula (ii) below and other tetrafunctional polycaprolactone polyols. Among these, polycaprolactone triols are particularly is preferable.

Structural Formula (i)

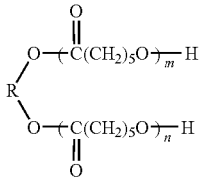

In Structural Formula (i) above, the sum of m and n is an integer of four to 35, and R represents any one of $C_2H_4$, $C_2H_4OC_2H_4$ and $C(CH_3)_2(CH_2)_2$.

Structural Formula (ii)

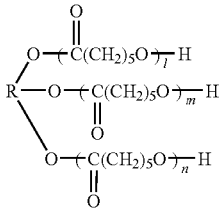

In Structural Formula (ii) above, the sum of l, m and n is an integer of three to 30, and R represents any one of $CH_2CHCH_2$, $CH_3C(CH_2)_3$ and $CH_3CH_2C(CH_2)_3$.

When a polycaprolactone is introduced to a skeleton of a polydimethylsiloxane copolymer, a radically polymerizable polycaprolactone is preferably used. Favorable examples of the radically polymerizable polycaprolactone include lactone-modified hydroxyethyl (meth)acrylates.

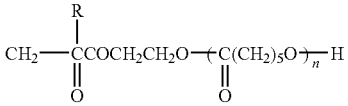

In the structural formula above, R represents a hydrogen atom or a methyl group, and n represents an integer of one to 25.

—Polysiloxane—

The polysiloxane is not particularly restricted and can be appropriately selected according to applications. Examples thereof include: partial hydrolysate of a silane compound including a hydrolizable silyl group such as tetramethoxysilane, tetraethoxysilane, methyltrimethoxysilane, methyltriethoxysilane, dimethyldimethoxysilane and dimethyldiethoxysilane; an organosilica sol that particles of silicic acid anhydride is stably dispersed m an organic solvent; and a compound that the silane compound with radical polymerizability is added with the organosilica sol.

The polysiloxane provides properties such as heat resistance and stain resistance to the obtained surface layer material and therefore it plays an important role for an improvement of the surface hardness of the surface layer material.

The polydimethylsiloxane copolymer is usually synthesized by means of solution polymerization. Examples of a solution in this solution polymerization include aromatic hydrocarbons solvents such as toluene and xylene; ketones solvents such as acetone, methyl ethyl ketone and methyl isobutyl ketone; esters solvents such as ethyl acetate, propyl acetate, isobutyl acetate and butyl acetate; alcohols solvents such as ethanol, isopropanol, butanol and isobutanol, and these are used alone or as a mixed solvent. Furthermore, an oil soluble polymerization initiator such as benzoyl peroxide, lauryl peroxide, cumene hydroperoxide and azobisisobutylonitrile are used according to requirements.

The solution polymerization takes place preferably at a reaction temperature of 50° C. to 150° C. and preferably for 3 hours to 12 hours.

When at least any one of polycaprolactone and polysiloxane is introduced in the skeleton of the polydimethylsiloxane copolymer, at least any one of polycaprolactone and polysiloxane is added for copolymerization in the polymerization of the polydimethylsiloxane copolymer. When the compositions are manufactured, each constituent is mixed in a usual manner.

The quantity of the polydimethylsiloxane moiety in the polydimethylsiloxane copolymer (including a composition to which at least any one of polycaprolactone and polysiloxane is introduced in the skeleton) is preferably 1% by mass to 30% by mass, and more preferably 1% by mass to 20% by mass. The polydimethylsiloxane moiety effectively provides lubricity to the photoconductor surface and reduces the tacking property. However, the above effects are not sufficiently provided when the quantity of the polydimethylsiloxane moiety is less than 1% by mass, and the quantity exceeding 30% by mass may reduce the stain resistance of the surface layer material.

The molecular weight of the polydimethylsiloxane moiety is preferably 1,000 to 30,000, and more preferably 5,000 to 20,000 so that it is effectively oriented on the surface of the surface layer material to provide lubricity.

The solid content of the polycaprolactone in the composition is preferably 5% by mass to 50% by mass, and more preferably 5% by mass to 30% by mass, whether it is introduced to the skeleton of the polydimethylsiloxane copolymer or exists independently in the composition.

The polycaprolactone provides the high impact resilience and favorable adhesion to the surface layer material and when an abrasive force is applied, it absorbs the abrasive force with energy elastic deformation. When the content of the polycaprolactone is less than 5% by mass, the abrasion resistance and chipping resistance of the surface layer material may degrade. When it exceeds 50% by mass, the stain resistance of the surface layer material may degrade.

The solid content of the polysiloxane in the composition is preferably 1% by mass to 20% by mass, and more preferably 3% by mass to 15% by mass, whether it is introduced to the skeleton of the polydimethylsiloxane copolymer or exists independently in the composition.

The polysiloxane provides the stain resistance, weather resistance and heat resistance to the surface layer material as well as improves the surface hardness of the surface layer material When the content of the polysiloxane is less than 1% by mass, the above effects may not be sufficiently provided. When it exceeds 20% by mass, the abrasion resistance of the surface layer material may degrade.

The surface layer material may be obtained by hardening the raw materials. Here, the polydimethylsiloxane copolymer (including a composition to which at least any one of polycaprolactone and polysiloxane is introduced in the skeleton) is preferably any one of urethane cross-linked material and melamine cross-linked material.

For the urethane cross-linking of the polydimethylsiloxane copolymer, an urethane cross-liking agent is added to the polydimethylsiloxane copolymer having an OH group and hardened. Examples of the urethane cross-linking agent include methylene-bis(4-cyclohexyl isocyanate), trimethylolpropane adduct of tolylene diisocyanate, trimethylolpropane adduct of hexamethylene diisocyanate, trimethylolpropane adduct of isophorone diisocyanate, isocyanurate of tolylene diisocyanate, isocyanurate of hexamethylene diisocyanate, isocyanurate of isophorone diisocyanate, biuret of hexamethylene diisocyanate; and a block isocyanate of the polyisocyanates Furthermore, dibutyl tin laurate or dibutyl tin diethylhexoate may be added as a catalyst according to requirements. The urethane cross-linked material may be dried at a room temperature or by baking. Preferably, the drying at a room temperature usually takes place for eight hours to one week, and the drying by baking takes place at 40° C. to 300° C. for five seconds to 120 minutes.

For the melamine cross-linked material of the polydimethylsiloxane copolymer, the raw materials are added with a melamine cross-linking agent such as alkoxymethylol melamine and cured. Furthermore, p-toluenesulfonic acid, trichloroacetic acid or tetrachlorophthalic acid may be added as a catalyst. For the melamine cross-linked material drying by baking is performed preferably at 80° C. to 250° C. for five seconds to 60 minutes.

It is preferable that the surface layer allows charge injection from the lower layer of the surface layer for the purpose of ensuring the sensitivity of the photoconductor and that a compound including α-phenylstilbene moiety, which has the superior charge transport property, is used for providing the charge transport property to this surface layer.

The compound including α-phenylstilbene moiety is preferably represented by Structural Formula (1) below.

Structural Formula (1)

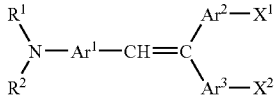

In Structural Formula (1) above, $R^1$ and $R^2$ are the same or different and represent a substituted or non-substituted aryl group.

Examples of the aryl group include: an aromatic hydrocarbon group such as phenyl group; a condensed polycyclic group such as naphthyl group, pyrenyl group, 2-fluorenyl group, 8,8-dimethyl-2-fluorenyl group, azulenyl group, anthryl group, triphenylenyl group, crycenyl group, fluorenylidenephenyl group and 5H-dibenzo[a,d]cycloheptenylidenephenyl group; a non-condensed polycyclic group such as biphenylyl group, terphenylyl group and group represented by Structural Formula (2) below; a heterocyclic group such as thienyl group, benzothienyl group, furyl group, benzofuranyl group and carbazolyl group.

Structural Formula (2)

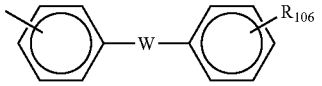

In Structural Formula (2), W represents —O—, —S—, —SO—, —$SO_2$—, —CO— and a group represented by structural formulae below; and $R_{106}$ represents a hydrogen or an alkyl group:

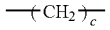

where c represents an integer of one to 12;

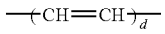

where d represents an integer of one to three;

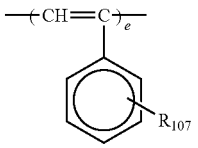

where $R_{107}$ represents a hydrogen atom or an alkyl group; and e represents an integer of one to three; and

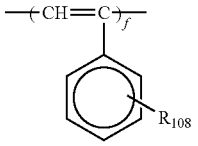

where $R_{108}$ represents a hydrogen atom or an alkyl group; and represents an integer of one to three.

$Ar^1$, $Ar^2$ and $Ar^3$ are the same or different and represent a substituted or non-substituted arylene group such as divalent group of aryl groups given for the $R^1$ and $R^2$ above.

The above aryl group and arylene group may include the following groups as a substituent. Also, these substituents represent examples of the $R_{106}$, $R_{107}$ and $R_{108}$.

(1) Halogen atom, trifluoromethyl group, cyano group and nitro group;

(2) straight-chain or branched-chain alkyl group having a carbon number of one to 12, preferably one to eight, and more preferably one to four: the alkyl group may further include a fluorine atom, a hydroxyl group, a cyano group, an alkoxy group having a carbon number of one to four, a phenyl group, a halogen atom, an alkyl group having a carbon number of one to four or a phenyl group substituted by an alkoxy group having a carbon number of one to four. Specific examples thereof include a methyl group, an ethyl group, an n-propyl group, an i-propyl group, a t-butyl group, an s-butyl group, an n-butyl group, an i-butyl group, a trifluoromethyl group, a 2-hydroxyethyl group, a 2-cyanoethyl group, a 2-ethoxyethyl group, a 2-methoxyethyl group, a benzyl group, a 4-chlorobenzyl group, a 4-methylbenzyl group, a 4-methoxybenzyl group and a 4-phenylbenzyl group.

(3) Alkoxy group ($—OR_{109}$): examples thereof include a methoxy group, an ethoxy group, an n-propoxy group, an i-propoxy group, a t-butoxy group, an n-butoxy group, an s-butoxy group, an i-butoxy group, a 2-hydroxyethoxy group, a 2-cyanoethoxy group, a benzyloxy group, a 4-methylbenzyloxy group and a trifluoromethoxy group.

(4) Aryloxy group: examples of the aryl group include a phenyl group and a naphthyl group. This may include an alkoxy group having a carbon number of one to four, an alkyl group having a carbon number of one to four or a halogen atom as a substituent. Specific examples include a phenoxy group, a 1-naphthyloxy group, a 2-naphthyloxy group, a 4-methylphenoxy group, a 4-methoxyphenoxy group, a 4-chlorophenoxy group and 6-methyl-2-naphthyloxy group.

(5) Substituted melcapto group or arylmelcapto group: examples thereof include a methylthio group, an ethylthio group, a phenylthio group and a p-methylphenylthio group.

(6) A group represented by the following structural formula:

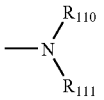

In the structural formula above, $R_{110}$ and $R_{111}$ represent independently an alkyl group or an aryl group.

Examples of the alkyl group include a methyl group, an ethyl group, an n-propyl group, an i-propyl group, a t-butyl group, an s-butyl group and an n-butyl group.

Examples of the aryl group include a phenyl group, a biphenyl group and a naphthyl group.

These alkyl groups and aryl groups may include an alkoxy group having a carbon number of one to four, an alkyl group having a carbon number of one to four or a halogen atom as a substituent. Also, a ring may be formed with carbon atoms in the aryl group. Specific examples thereof include a diethylamino group, an N-methyl-N-phenylamino group, an N,N-diphenylamino group, an N,N-di(p-tolyl)amino group, a dibenzylamino group, a piperidine group, a morpholino group and a julolidyl group.

(7) Alkylenedioxy group such as methylenedioxy group and methylenethio group; and an alkylenedithio group.

$X^1$ and $X^2$ are the same or different and represent any one of a hydroxyl group and $—O—(CH_2)_p—OH$, where p represents an integer of one to 10.

The charge transport material represented by Structural Formula (1) easily dissolves in a solvent such as alcohols and cellosolves, and film formation with these solvents enables a formation of a dear and uniform film and is effective.

The formulation of the charge transport material in the surface layer as explained above enhances the charge stability. As a result, the difference in the dielectric constant with the lower layer is often eased. The discrepancy of the dielectric constant between the surface layer and the lower layer causes an imbalance of charge and discharge in the respective layers, and it becomes difficult to ensure the charge stability. Therefore, an abnormal image such as afterimage may occur. The formulation of the charge transport material is advantageous for providing the high reliability since it improves the sensitivity as well as provides the charge stability.

The surface layer is not necessarily as thick as the charge transport layer as a part of the photoconductor, e.g. about 15 μm to 40 μm, and thus it does not require the content of the charge transport component which ensures the charge mobility equivalent to the charge transport layer, i.e. 30% by mass to 70% by mass with respect to the total mass of the charge transport layer. However, the content of the charge transport layer in the surface layer represented by Structural Formula (1) above is preferably 1% by mass to 50% by mass, and more preferably 5% by mass to 30% by mass.

The surface layer may be added with a conductive filler, i.e. specific resistance reducing agent, an alternative means to ensure the sensitivity of the photoconductor for enabling the charge injection from the front face of the surface layer. It is preferable that the conductive filler cures the surface layer and that its transparency is maintained even after the film formation. Examples thereof include ITO particles and tin oxide particles.

A common organic solvent may be used as a dispersion solvent for preparing the surface layer coating. However the contamination with the soluble fraction of the lower layer during the film formation is not preferable because causes insufficient curing or the formation of a site accumulating the rest potential. It is preferable to dissolve or disperse sufficiently the component of the surface layer coating as well as to select a solvent such that the solubility with respect to the lower layer is 1 mL/10 mg or less. In this case, although it varies depending on the material of the lower layer, alcohols and cellosolves may be easily used.

On the other hand, severe accumulation of rest potential is observed when the surface layer coating component contaminates the lower layer and a trapping site is formed. This is presumably because the accumulation is proportional to the square of the thickness according to the relation of Poisson's equation. Thus, it is highly important to select a solvent which does not dissolve the lower layer.

Methods for forming the surface layer include, for example, a dip-coating method, a spray-coating method, a ring-coating method, a roller-coating method, a gravure-coating method, a nozzle coating method and a screen printing method may be used. Among these, the spray-coating method and the ring-coating methods are particularly suitable since it is relatively easy in terms of production to achieve the stability of the quality.

The surface layer has a thickness of preferably 1 μm to 10 μm, and more preferably 2 μm to 5 μm.

<Laminated Photoconductive Layer>

The laminated photoconductive layer includes at least a charge generating layer and a charge transport layer in this order, and it further includes an intermediate layer and other layers according to requirements.

—Charge Generating Layer—

The charge generating layer includes at least a charge generating material, and it further includes a binder resin and other components according to requirements.

The charge generating material is not particularly restricted and can be appropriately selected according to applications, and any one of an inorganic material and an organic material may be used.

The inorganic material is not particularly restricted and can be appropriately selected according to applications. Examples thereof include crystalline selenium, amorphous-selenium, selenium-tellurium, selenium-tellurium-halogen and a selenium-arsenic compound.

The organic material is not particularly restricted and can be appropriately selected from heretofore known materials according to applications. Examples thereof include phthalocyanine pigments such as metal phthalocyanine and metal-free phthalocyanine, azulenium salt pigments, squaric acid methine pigment, azo pigments having a carbazole moiety, azo pigments having a triphenylamine moiety, azo pigments having a diphenylamine moiety, azo pigments having a dibenzothiophene moiety, azo pigments having a fluorenone moiety, azo pigments having an oxadiazole moiety, azo pigments having a bisstilbene moiety, azo pigments having a distyryl oxadiazole moiety, azo pigments having a distyrylcarbazole moiety, perylene pigments, anthraquinone or polycyclic quinone pigments, quinone imine pigments, diphenylmethane or triphenylmethane pigments, benzoquinone or naphtoquinone pigments, cyarine pigments, azomethine pigments, indigoido pigments and bisbenzimidazole pigments. These may be used alone or in combination of two or more.

The binder resin is not particularly restricted and can be appropriately selected according to applications. Examples thereof include a polyamide resin, a polyurethane resin, an epoxy resin, a polyketone resin, a polycarbonate resin, a silicone resin, an acrylic resin, a polyvinyl butyral resin, a polyvinyl formal resin, a polyvinyl ketone resin, a polystyrene resin, a poly-N-vinyl carbazole resin and a polyacrylamide resin. These may be used alone or in combination of two or more.

A charge transport material may be added according to requirements. Also, other than the above-mentioned binder resins, a polymeric charge transfer material having a charge transferring function may be used as a binder resin in the charge generating layer.

There are mainly two types of the methods for forming the charge generating layer, namely a vacuum thin-film preparation method and a casting method with solution dispersal.

Examples of the vacuum thin-film preparation method include a glow discharge electrolysis method, a vacuum deposition method, a CVD method, a sputtering method, a reactive sputtering method, an ion plating method and an accelerated ion injection method. Favorable film formation of the above-mentioned inorganic materials and organic materials is possible with these vacuum thin-film preparation methods.

The charge transport layer may be formed with the casting method by using a charge generating layer coating solution and by using common methods such as dip-coating method, spray-coating method and bead-coating method.

Regarding an organic solvent used for the charge generating layer coating solution, examples thereof include acetone, methyl ethyl ketone, methyl isopropyl ketone, cyclohexane, benzene, toluene, xylene, chloroform, dichloromethane, dichloroethane, dichloropropane, trichloroethane, trichloroethylene, tetrachloroethane, tetrahydrofuran, dioxolane, dioxane, methanol ethanol isopropyl alcohol, butanol ethyl acetate, butyl acetate, dimethylsulfoxide, methyl cellosolve, ethyl cellosolve and propyl cellosolve. These may be used alone or in combination of two or more.

Among these, tetrahydrofuran, methyl ethyl ketone, dichloromethane, methanol and ethanol having a boiling point of 40° C. to 80° C. are particularly favorable for easy drying after coating.

The charge generating layer coating solution is produced by dispersing or dissolving the charge generating material and the binder resin in the organic solvent. The method for dispersing an organic pigment in an organic solvent includes a dispersion method be means of a dispersing medium such as ball mill, bead mill sand mill and vibrating mill and a high-speed liquid colliding dispersion method.

The electrophotographic property, especially light sensitivity, varies according to the thickness of the charge generating layer, and generally speaking, the light sensitivity is higher with larger thickness. Therefore the thickness of the charge generating layer is preferably configured in a favorable range according to the required specifications of the image forming apparatus. For the sensitivity required as a latent electrostatic image bearing member of an electrophotographic method, the thickness is preferably 0.01 μm to 5 μm, and more preferably 0.05 μm to 2 μm.

—Charge Transport Layer—

The charge transport layer is aimed at maintaining the electrification charge as well as transferring the charge generated and separated in the charge generating layer and binding it with the maintained electrification charge. High electric resistance is required to maintain the electrification charge.

Also, small dielectric constant and favorable charge mobility are required to obtain high surface potential with the maintained electrification charge.

The charge transport layer includes at least charge transport materials, and it further includes a binder resin and other components according to requirements.

The charge transport materials are categorized into hole transport materials, electron transport materials and polymeric charge transport materials.

Examples of the electron transport materials, i.e. electron accepting substances, include chloranil, bromanil, tetracyanoethylene, tetracyanoquinodimethane, 2,4,7-trinitro-9-fluorenone, 2,4,5,7-tetranitro-9-fluorenone, 2,4,5,7-tetranitroxanthone, 2,4,8-trinitrothioxanthone, 2,6,8-trinitro-4H-indeno[1,2-b]thiophene-4-one and 1,3,7-nitrodibenzothiophene-5,5-dioxide. These may be used alone or in combination of two or more.

Examples of the hole transport materials include electron donating substances, include an oxazole derivative, an oxadiazole derivative, an imidazole derivative, a triphenylamine derivative, 9-(p-diethylaminostyrylanthracene), 1,1-bis-(4-dibenzylaminophenyl)propane, styrylanthracene, styrylpyrazoline, phenylhydrozone ring, an α-phenylstilbene derivative, a thiazole derivative, a triazole derivative, a phenazine derivative, an acridine derivative, a benzofuran derivative, a benzimidazole derivative and a thiophene derivative. These may be used alone or in combination of two or more.

The polymeric charge transport materials include a material having the following structures.

(a) A Polymer Having a Carbazole Ring

Examples thereof include poly-N-vinyl carbazole and compounds disclosed in JP-A Nos. 50-82056, 54-9632, 54-11737, 04-175337, 04-183719 and 06-234841

(b) A Polymer Having a Hydrazone Moiety

Examples thereof include compounds disclosed in JP-A Nos. 57-78402, 61-20953, 61-296358, 01-134456, 01-179164, 03-180851, 03-180852, 03-50555, 05-310904 and 06-234840.

(c) Polysilylene Polymer

Examples thereof include compounds disclosed in JP-A Nos. 63-285552, 01-88461, 04-264130, 04-264131, 04-264132, 04-264133 and 04-289867.

(d) Polymer Having a Triarylamine Moiety

Examples thereof include N,N-bis(4-methylphenyl-4-aminopolystyrene and compounds disclosed in JP-A Nos. 01-134457, 02-282264, 02-304456, 04-133065, 04-133066, 05-40350 and 05-202135.

(e) Other Polymers

Examples thereof include a formaldehyde polycondensate of nitropyrene and compounds disclosed in JP-A Nos. 51-73888, 56-150749, 06-234836 and 06-234837.

Other examples of the polymeric charge transport materials include a polycarbonate resin having a triarylamine moiety, a polyurethane resin having a triarylamine moiety, a polyester resin having a triarylamine moiety and a polyether resin having a triarylamine moiety.

The examples further include compounds disclosed in JP-A Nos. 64-1728, 64-13061, 64-19049, 04-11627, 04-225014, 04-230767, 04-320420, 05-232727, 07-56374, 09-127713, 09-222740, 09-265197, 09-211877 and 09-304956.

As a polymer having an electron donating group, a copolymer with a heretofore known monomer, a block polymer, a graft polymer, a star polymer and furthermore a cross-linking polymer having an electron donating group as disclosed in JP-A No. 03-109406 may also be used other than the polymers listed above.

Examples of the binder resin include a polycarbonate resin, a polyester resin, a methacrylic resin, an acrylic resin, a polyethylene resin, a polyvinyl chloride resin, polyvinyl acetate resin, a polystyrene resin, a phenol resin, an epoxy resin, a polyurethane resin, a polyvinylidene chloride resin, an alkyd resin, a silicone resin, a polyvinyl carbazole resin, a polyvinyl butyral resin, a polyvinyl formal resin, a polyacrylate resin, a polyacrylamide resin and a phenoxy resin These may be used alone or in combination of two or more.

The charge transport layer may also include a copolymer of a cross-linkable binder resin and a cross-linkable charge transport material.

The charge transport substance and a binder resin are dissolved or dispersed in an appropriate solvent, and the solution or dispersion is coated and dried to form the charge transport layer. Other than the charge transport substance and binder resin, the charge transport layer may further include additives such as plasticizer, antioxidant and leveling agent according to requirements.

The thickness of the charge transport layer is preferably 5 μm to 100 μm. The recent demand for high image quality has thinned the charge transport layer, and the thickness of 5 μm to 30 μm is more preferable for achieving high image quality of 1,200 dpi or greater.

<Single-Layer Photoconductive Layer>

The single-layer photoconductive layer includes a charge generating material, a charge transport material and a binder resin, and it further includes other components according to requirements.

The above-mentioned materials may be used for the charge generating material, charge transport material and the binder resin.

When the single-layer photoconductive layer is disposed with the casting method, the single-layer photoconductive layer may often be formed by dissolving or dispersing the charge generating material as well as low-molecular and polymeric charge transport materials in an appropriate solvent and by coating and drying the solution. A plasticizer may also be added to the single-layer photoconductive layer according to requirements. As a binder resin which may further be used according to requirements, the binder resins mentioned above for the charge transport layer may also be used. In addition, binder resins for the charge generating layer may be mixed and used.

The thickness of the single-layer photoconductive layer is preferably 5 μm to 100 μm, and more preferably 5 μm to 50 μm. The thickness of less than 5 μm may reduce the charge property, and the thickness exceeding 100 μm may reduce the sensitivity.

In the present invention, each layer may be added with antioxidant, plasticizer, ultraviolet absorber, low-molecular charge transport material and leveling agent to improve the gas barrier property of the surface layer and improving the environmental resistance. Typical materials for these compounds are listed below.

Examples of the antioxidant which may be added to each layer include the following (a) to (d), but it is not restricted to these:

(a) Phenolic Antioxidant

Examples of phenolic antioxidants include 2,6-di-t-butyl-p-cresol, 2,4,6-tri-t-butylphenol n-octadecyl-3-(4'-hydroxy-3',5'-di-t-butylphenol)propionate, styrenated phenol 4-hydroxymethyl-2,6-di-t-butylphenol, 2,5-di-t-butylhydroquinone, cyclohexylphenol butylhydroxyanisole, 2,2'-methylene-bis(4-ethyl-6-t-butylphenol), 4,4'-i-propylidene bisphenol 1,1-bis(4-hydroxyphenyl)cyclohexane, 4,4'-methylene-bis(2,6-di-t-butylphenol), 2,6-bis(2'-hydroxy-3'-t-butyl-5'-methylbenzyl)-4-methylphenol 1,1,3-tris(2-methyl-4-hydroxy-5-t-butylphenyl)butane, 1,3,5-trismethyl-2,4,6-tris(3,5-di-t-butyl-4-hydroxybenzyl)benzene, tetrakis[methylene-3-(3,5-di-t-butyl-4-hydroxyphenyl)propionate]methane, tris(3,5-di-t-butyl-4-hydroxyphenyl)isocyanate, tris[β-(3,5-di-t-butyl-4-hydroxyphenyl)propionyloxyethyl]isocyanate, 4,4'-thiobis(3-methyl-6-t-butylphenol), 2,2'-thiobis(4-methyl-6-t-butylphenol) and 4,4'-thiobis(4-methyl-6-t-butylphenol).

(b) Amine Antioxidant

Examples of the amine antioxidants include phenyl-α-naphthylamine, phenyl-β-naphthylamine, N,N'-diphenyl-p-phenylene diamine, N,N'-di-β-naphthyl-p-phenylenediamine, N-cyclohexyl-N'-phenyl-p-phenylene diamine, N-phenylene-N'-i-propyl-p-phenylene diamine, aldol-α-naphthylamine and 6-ethoxy-2,2,4-trimethyl-1,2-dihydroquinoline.

(c) Sulfuric Antioxidant

Examples of sulfuric antioxidants include thiobis(β-naphthol), thiobis(N-phenyl-β-naphthylamine), 2-mercaptobenzidazole, dodecylmercaptan, tetramethylthiuram monosulfide, tetramethylthiuram disulfide, nickel dibutylthiocarbamate, isopropylxanthate, dilaurilthiodipropionate and distearilthiodipropionate (d) Phosphorus Antioxidants Examples of phosphorous antioxidants include triphenylphosphite, phenylisodecylphosphite, tri(nonylphenyl) phosphite, 4,4'-butylidene-bis(3-methyl-6t-butylphenyl-ditridecylphosphite), distearyl-pentaerythritol diphosphite and trilauril trithiophosphite.

Examples of the plasticizer which may be added to each layer include the following (a) to (m), but it is not restricted to these:

(a) Phosphate-based Plasticizers

Examples of phosphate-based plasticizers include triphenyl phosphate, tricresyl phosphate, trioctyl phosphate, octyl diphenyl phosphate, trichloroethyl phosphate, cresyl diphenyl phosphate, tributyl phosphate and tri-2-ethylhexyl phosphate.

(b) Phthalate-based Plasticizers

Examples of phthalate-based plasticizers include dimethyl phthalate, diethyl phthalate, diisobutyl phthalate, dibutyl phthalate, diheptyl phthalate, di-2-ethylhexyl phthalate, diisooctyl phthalate, di-n-octyl phthalate, dinonyl phthalate, diisononyl phthalate, diisodecyl phthalate, diundecyl phthalate, ditridecyl phthalate, dicyclohexyl phthalate, butyl benzyl phthalate, butyl lauril phthalate, methyl oleyl phthalate, octyl decyl phtlalate, dibutyl fumarate and dioctyl fumarate.

(c) Aromatic Carboxylate-based Plasticizers

Examples of aromatic carboxylate-based plasticizers include trioctyl trimellitate, tri-n-octyl trimellitate and octyl oxybenzoate.

(d) Aliphatic Dibasic Acid Ester-based Plasticizers

Examples of aliphatic dibasic acid ester-based plasticizers include dibutyl adipate, di-n-hexyl adipate, di-2-ethylhexyl adipate, di-n-octyl adipate, n-octyl n-decyl adipate, diisodecyl adipate, dicaprylic adipate, di-2-ethylhexyl azelate, di-n-octyl sebacate, diethyl sebacate, dibutyl sebacate, di-n-octyl sebacate, di-2-ethylhexyl sebacate, di-2-ethoxyethyl sebacate, dioctyl succinate, diisodecyl succinate, dioctyl tetrahydrophthalate and di-n-octyl tetrahydrophthalate.

(e) Fatty Ester Derivatives

Examples of fatty ester derivatives include butyl oleate, glycerin monooleate, methyl acetyl ricinoleate, pentaerythritol ester, dipentaerythritol hexaester, triacetin and tributyrin.

(f) Oxycarboxylate-based Plasticizers

Examples of oxycarboxylate-based plasticizers include methyl acetylricinoleate, butyl acetylricinoleate, butyl phthalyl butyl glycolate and tributyl acetylcitrate.

(g) Epoxy Plasticizers

Examples of epoxy plasticizers include epoxidized soybean oil, epoxidized flaxseed oil, butyl epoxy stearate, decyl epoxy stearate, octyl epoxy stearate, benzyl epoxy stearate, dioctyl epoxy hexahydrophthalate and didecyl epoxy hexahydrophthalate.

(h) Plasticizing Dihydric Alcohol Esters

Examples of plasticizing dihydric alcohol esters include diethylene glycol dibenzoate and triethylene glycol di-2-ethylbutyrate.

(i) Plasticizers Including Chlorine

Examples of plasticizers including chlorine include chlorinated paraffin, chlorinated diphenyl chlorinated fatty acid methyl ester and methoxy chlorinated fatty acid methyl ester.

(j) Polyester-based Plasticizers

Examples of polyester-based plasticizers include polypropyrene adipate, polypropyrene sebacate, polyester and acetylized polyester.

(k) Sulfonic Acid Derivatives

Examples of sulfonic acid derivatives include p-toluene sulfonamide, o-toluene sulfonethylamide, p-toluene sulfonethylamide, o-toluene sulfonethylamide, toluene sulfone-N-ethylamide and p-toluene sulfone-N-cyclohexylamide.

(l) Citric Acid Derivatives

Examples of citric acid derivatives include triethyl citrate, triethyl acetylcitrate, tributyl citrate, tributyl acetylcitrate, tri-2-ethylhexyl acetylcitrate and n-octyldecyl acetylcitrate.

(m) Others

Others include terphenyl partially-hydrated terphenyl camphor, 2-nitrodiphenyl dinonylnaphthalene and methyl abietate.

The following (a) to (f) list ultraviolet absorbents which can be added to each layer, but it is not limited to these.

(a) Benzophenone Ultraviolet Absorbents

Benzophenone derivatives including 2-hydroxybenzophenone, 2,4-dihydroxybenzophenone, 2,2',4'-trihydroxybenzophenone, 2,2',4,4'-tetrahydroxybenzophenone and 2,2'-dihydroxy-4-methoxybenzophenone.

(b) Salicylate Ultraviolet Absorbents

Salicylates including phenyl salicylate and 2,4-di-t-butyl-3,5-di-t-butyl-4-hydroxybenzoate.

(c) Benzotrizole Ultraviolet Absorbents

Benzotriazole derivatives including (2'-hydroxyphenyl) benzotriazole, (2'-hydroxy-5'-methylphenyl)benzotriazole and (2'-hydroxy-3'-t-butyl-5'-methylphenyl)-5-chlorobenzotriazole.

(d) Cyanoacrylate Ultraviolet Absorbents

Cyanoacrylates including ethyl-2-cyano-3,3-diphenylacrylate and methyl-2-carbomethoxy-3-(p-methoxy)acrylate.

(e) Quenchers (Metal Complex Salts)

Quenchers including nickel[2,2'-thiobis(4-t-octyl)phenolate]-n-butylamine, nickel dibutyldithiocarbamate and cobalt dicyclohexyldithiophosphate.

(f) HALS (Hindered Amines)

HALS including bis(2,2,6,6-tetramethyl-4-piperidyl)sebacate, bis(1,2,2,6,6-pentamethyl-4-piperidyl)sebacate, 1-[2-[3-(3,5-di-t-butyl-4-hydroxyphenyl)propionyloxy]ethyl]-4-[3-(3,5-di-t-butyl-4-hydroxyphenyl)propionyloxy]-2,2,6,6-tetramethylpyridine, 8-benzyl-7,7,9,9-tetramethyl-3-octyl-1,3,8-triazaspiro[4,5]undecane-2,4-dione and 4-benzoyloxy-2,2,6,6-tetramethylpyridine.

A low-molecular charge transport materials which may be added to each layer is synonymous to those described for the charge generating layer.

—Support—

The support is not particularly restricted as long as it has an electric conductivity, and it can be appropriately selected according to applications. An electric conductor or an insulator with conductive treatment is favorable, and examples thereof include: metals such as Al, Ni, Fe, Cu and Au and alloys thereof; a support having a thin film of metal such as Al, Ag and Au or a conductive material such as $In_2O_3$ and $SnO_2$ formed on an insulating support such as polyester, polycarbonate, polyimide and glass; a resin support that a metal powder or a conductive glass powder such as carbon black graphite, Al, Cu and Ni is uniformly dispersed in a resin to provide conductivity to a resin, and paper with conductive treatment.

The support is not particularly restricted in terms of shape and size, and sheet-type, drum-type or belt-type support may be used. For example, a belt-type support increases the complexity and size of the apparatus since it requires a driving roller and a driven roller, but on the other hand, it provides merits such as increased flexibility of layout. When a protective layer is formed, however, there is a possibility that the surface is cracked due to insufficient flexibility of the protective layer. This presumably results in the occurrence of background smear. Therefore, a drum-type support having high stiffness is favorable as a support.

An undercoat layer may be provided between the support and the photoconductive layer according to requirements. The undercoat layer is provided for the purposes of improving the adhesion, preventing moirés, improving the coating property of the upper layer and reducing the rest potential.

The undercoat layer generally includes resins as a main component, and these resins preferably have low solubility with respect to common organic solvents, considering that a photoconductive layer is coated with a solvent over these resins.

Examples of the resins include water-soluble resins such as polyvinyl alcohol casein, sodium polyacrylate; alcohol-soluble resins such as copolymer nylon and methoxy methylated nylon; a curing resin which forms three-dimensional network such as polyurethane resin, melamine resin, alkyd-melamine resin and epoxy resin.

Also, the undercoat layer may be added with a fine powder of metal oxide titanium oxide, silica, alumina, zirconium oxide, tin oxide and indium oxide, metal sulfide or metal nitride. An undercoat layer thereof may be formed by means of a common coating method with an appropriate solvent.

Also, as the undercoat layer, metal oxide layer formed with silane coupling agents, titanium coupling agents and chromium coupling agents by means of a sol-gel method, a layer formed with an anodic oxidation of $Al_2O_3$ or a layer formed with organic materials such as polyparaxylylene (parylene) and inorganic materials such as $SiO_2$, $SnO_2$, $TiO_2$, ITO and $CeO_2$ by means of a vacuum thin-film preparation process may be used.

The thickness of the undercoat layer is not particularly restricted and can be selected according to applications. It is preferably 0.1 μm to 10 μm, and more preferably 1 μm to 5 μm.

In the latent electrostatic image bearing member, i.e. photoconductor, an intermediate layer may be provided on the support according to requirements to improve the adhesion property and charge blocking property. The intermediate layer generally has resins as a main component, and these resins preferably have low solubility with respect to common organic solvents, considering that a photoconductive layer is coated with a solvent over these resins.

Examples of the resins include water-soluble resins such as polyvinyl alcohol casein, sodium polyacrylate; alcohol-soluble resins such as copolymer nylon and methoxy methylated nylon; a curing resin which forms three-dimensional network such as polyurethane resin, melamine resin, phenol resin, alkyd-melamine resin and epoxy resin.

(Image Forming Method and Image Forming Apparatus)

An image forming apparatus of the present invention contains at least a latent electrostatic image bearing member, a latent electrostatic image forming unit, a developing unit, a transferring unit and a fixing unit, and it further contains other units appropriately selected according to requirements such as discharging unit, cleaning unit, recycling unit and controlling unit.

An image forming method of the present invention contains at least a latent electrostatic image forming process, a developing process, a transferring process and a fixing process, and it further contains other processes appropriately selected according to requirements such as discharging process, cleaning process, recycling process and controlling process.

The image forming method of the present invention may be favorably performed by means of the image forming apparatus of the present invention. The latent electrostatic image forming process may be performed by the latent electrostatic image forming unit, the developing process may be performed by the developing unit, the transferring process may be performed by the transferring unit, the fixing process may be performed by the fixing unit, and the other processes may be performed by the other units.

—Latent Electrostatic Image Forming Process and Latent Electrostatic Image Forming Unit—

The latent electrostatic image forming process is a process to form a latent electrostatic image on the latent electrostatic image bearing member.

As the latent electrostatic image bearing member, the latent electrostatic image bearing member of the present invention is used.

The latent electrostatic image may be formed, for example, by charging uniformly the surface of the latent electrostatic image bearing member followed by imagewise exposure, which may be performed by the latent electrostatic image forming unit.

The latent electrostatic image forming unit houses at least a charging part that uniformly charges the surface of the latent electrostatic image bearing member and an exposing part that performs an imagewise exposure. The charging may be performed, for example, by applying an electric potential to the surface of the latent electrostatic image bearing member with the charging part.

The charging part is not particularly restricted and can be appropriately selected according to applications. Examples thereof include a contact charging unit, which itself is heretofore known, having a conductive or semiconductive roll, a brush, a film or a rubber blade; and a noncontact charging unit utilizing corona discharge such as corotron and scorotron.

The configuration of the charging member may be in the form of, other than a roller, a magnetic brush and a fur brush, and it may be selected according to the specification and the configuration of the electrophotographic apparatus. The magnetic brush is configured with: various types of ferrite particles such as Zn—Cu ferrite used as a charging member; a nonmagnetic conductive sleeve for supporting the charging member; and a magnet roller included in the sleeve. Regarding the fur brush, a conduction-processed fur with carbon, copper sulfate, metal or metal oxide for conductivity is used as a material for the fur brush, and a charging unit is formed by wrapping or pasting the fur on a metal shaft or a conduction-processed shaft.

The charging part is not restricted to the contact charging parts above, but the use of a contact charging part is preferable since an image forming apparatus may be obtained with which the generation of the ozone from the charging part is suppressed.

It is preferable that the charging part is placed in contact with or not in contact with the latent electrostatic image bearing member and that a direct and alternating voltages are superimposed and applied to the charge roller to electrify the surface of the latent electrostatic image bearing member.

It is preferable that the charging unit is a charge roller which is allocated near but without contacting the latent electrostatic image bearing member though a gap tape and that a direct and alternating voltages are superimposed and applied to the charge roller to electrify the surface of the latent electrostatic image bearing member.

The exposure may be performed, for example, by exposing imagewise the surface of the latent electrostatic image bearing member with the exposing part.

The exposing unit is not particularly restricted as long as it can perform an imagewise exposure as intended on the surface of the latent electrostatic image bearing member charged by the charging part, and it can be appropriately selected according to applications. Examples of the exposing unit include a copying optical system, a rod lens array system, a laser optical system and liquid crystal shutter optical system.

In the present invention, the back-exposure method may be adopted in which an exposure is performed imagewise from the back side of the latent electrostatic image bearing member.

—Developing Process and Developing Unit—

The developing process is a process to develop the latent electrostatic image using a toner or a developer to form a visible image.

The formation of the visible image may be performed by developing the latent electrostatic image using the toner or the developer, and it may be performed by the developing unit.

The developing unit is not particularly restricted as long as it can perform a development using the toner or the developer, and it can be appropriately selected from heretofore known developing units. For example, a preferable developing unit contains the toner or the developer and includes a developing part which can impart the toner or the developer in a contact or noncontact manner to the latent electrostatic image.

The developing part may be of a dry development or a wet development. It may also be a monochrome developing part or a multi-color developing part. For example, a developer having an agitator that frictions and agitates the toner or the developer for electrification and a rotatable magnet roller is preferable.

In the developing part, for example, the toner and the carrier are mixed and agitated, which causes a friction to charge the toner and maintains the charged toner on the surface of the rotating magnet roller in a state of a chain of magnetic particles, and a magnetic brush is formed. The magnet roller is arranged near the latent electrostatic image bearing member, i.e. photoconductor; therefore, the toner constituting the magnetic brush formed on the surface of the magnetic roller partially transfers to the surface of the latent electrostatic image bearing member, i.e. photoconductor, due to electric attraction. As a result, the latent electrostatic image is developed by the toner, and a visible image by the toner is formed on the surface of the latent electrostatic image bearing member, i.e. photoconductor.

The developer contained in the developing part may be a one-component developer or a two-component developer.

—Transferring Process and Transferring Unit—

The transferring process is a process to transfer the visible image to a recording medium. The transferring process preferably has an aspect that, with an intermediate recording medium, it performs a primary transfer to transfer the visible image to the intermediate recording medium followed by a secondary transfer to transfer the visible image to the recording medium. An aspect which includes a primary transferring process that transfers the visible image to the intermediate recording medium to form a complex transfer image and a secondary transferring process that transfers the complex transfer image to the recording medium using a toner having two or more colors or preferably a full-color toner is more preferable.

The transfer of the visible image may be performed by charging the latent electrostatic image bearing member, i.e. photoconductor, using a transfer charging part, and it may be performed by the transferring unit. The transferring unit preferably has an aspect that includes a primary transferring unit that transfers a visible image to an intermediate recording medium to form a complex transfer image and a secondary transferring unit that transfers the complex transfer image to a recording medium.

The intermediate recording medium is not particularly restricted and can be appropriately selected according to applications from heretofore known recording media. Favorable examples include a transfer belt.

The transferring units, i.e. the primary transferring unit and the secondary transferring unit, preferably contain at least a transferring part that strips and charges the visible image formed on the latent electrostatic image bearing member, i.e. photoconductor, to the side of the recording medium. There may be one transferring unit, or there may be two or more.

Examples of the transferring part include a corona transferring unit by corona discharge, a transfer belt, a transfer roller, a pressure transfer roller and an adhesive transferring part.

Also, the typical recording medium is plain paper, but it is not particularly restricted as long as an unfixed image after developing can be transferred. It can be appropriately selected according to applications, and a PET base for OHP may be used.

—Fixing Process and Fixing Unit—

The fixing process is a process to fix the visible image transferred to the recording medium by means of a fixing apparatus. It may be performed every time a toner of each color is transferred to the recording medium, or it may be performed at once when a toner of all colors is laminated.

The fixing apparatus is not particularly restricted and can be selected appropriately according to applications. A heretofore known hot-pressing unit is favorable. Examples of the hot-pressing unit include a combination of a heat roller and a pressure roller and a combination of a heat roller, a pressure roller and an endless belt.

In general the heating in the hot-pressing unit is preferably 80° C. to 200° C.

In the present invention, a heretofore known optical fixing part, for example, may be used along with or in place of the fixing process and the fixing unit according to applications.

—Discharging Process and Discharging Unit—

The discharging process is a process to discharge the latent electrostatic image bearing member by applying a discharging bias, and it may be favorably performed by a discharging unit.

The discharging unit is not particularly restricted as long as the discharging bias is applied to the latent electrostatic image bearing member. It can be appropriately selected from heretofore known discharging parts, and favorable examples include a discharge lamp.

—Cleaning Process and Cleaning Unit—

The cleaning process is a process to remove the residual toner on the latent electrostatic image bearing member, and it may be favorably performed by a cleaning unit.

The cleaning unit is not particularly restricted as long as it can remove the electrophotographic toner remaining on the latent electrostatic image bearing member, and it can be appropriately selected from heretofore known cleaners. Favorable examples thereof include a magnetic brush cleaner, a static brush cleaner, a magnetic roller cleaner, a blade cleaner, a brush cleaner and a web cleaner.

Also, the image forming apparatus preferably includes a lubricant coating unit which applies a lubricant to the surface of the latent electrostatic image bearing member. The lubricant is favorably a metal soap, for example. Examples of the metal soap include zinc stearate, aluminum stearate and calcium stearate.

—Recycling Process and Recycling Unit—

The recycling process is a process to recycle the electrophotographic toner removed in the cleaning process to the developing means, and it may be favorably performed by a recycling unit.

The recycling unit is not particularly restricted, and a heretofore known transporting unit may be used.

—Controlling Process and Controlling Unit—

The controlling process is a process to control each of the above-mentioned processes, and it may be favorably performed by a controlling unit.

The controlling means is not particularly restricted as long as it can control the behavior of each unit. Examples thereof include equipment such as sequencer and computer.

Figure 6:
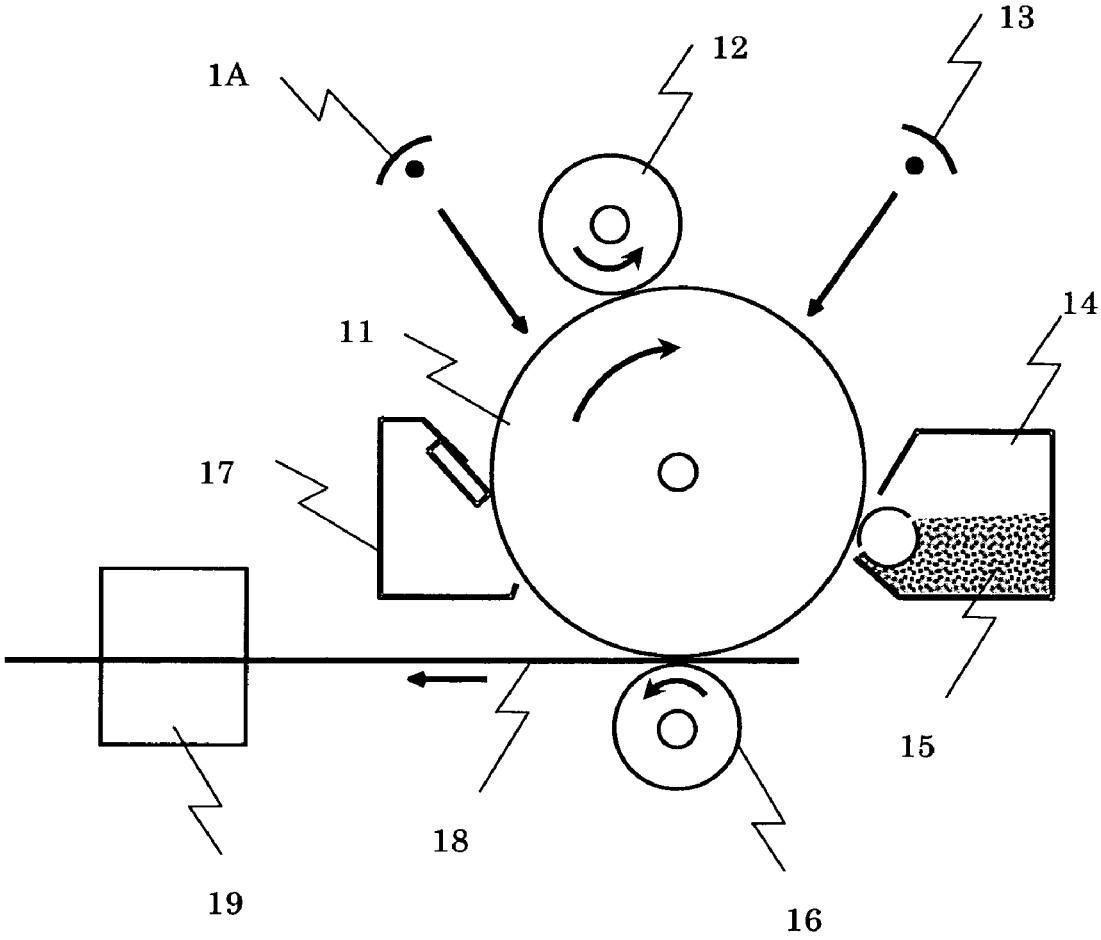
FIG. 6 is a schematic diagram showing an example of an image forming apparatus of the present invention.

FIG. 6 is a schematic diagram showing an example of an image forming apparatus of the present invention, and modified examples described below belong to the category of the present invention.

In FIG. 6, a latent electrostatic image bearing member, i.e. photoconductor, 11 includes at least a charge generating material and a charge transport material, and it has a self-repairing function on the surface of the photoconductor as well. The figure shows the photoconductor 11 having a shape of a drum, but it may be in a shape of a sheet or an endless belt.

For a charging unit 12, a heretofore known unit such as corotron, scorotron, solid state charger and charging roller is used. The charging unit arranged in contact or closely to the photoconductor is preferable in view of reduced electric power consumption. Among these, a charging mechanism which is arranged closely near the photoconductor with an appropriate space between the photoconductor and the surface of the charging unit is preferable since the contamination to the charging unit may be prevented. The above charger may be used for a transferring unit 16, and the combination of a transfer charger and a separation charger is effective.

A light source used for an image exposing unit 13 and a discharging unit 1A may be light-emitting materials in general such as fluorescent lighting, tungsten lamp, halogen lamp, mercury lamp, sodium lamp, light-emitting diode (LED), laser diode (LD) and electroluminescence (EL). Various filters such as sharp-cut filter, band-pass filter, near-infrared-cut filter, dichroic filter, interference filter and color-temperature conversion filter may be used to irradiate only a light with a desired wavelength.

A toner 15 developed on the photoconductor by means of a developing unit 14 is transferred to a recording medium 18. Here, the toner is not completely transferred, but some remains on the photoconductor. Such toner is removed from the photoconductor by means of a cleaning unit 17. The cleaning unit may be a rubber cleaning blade or a brush such as fur brush and mag fur brush.

When an image exposure is performed with a positively (negatively) charged photoconductor, a positive negative) latent electrostatic image is formed on the surface of the photoconductor. A positive image may be obtained by developing this with a negative (positive) toner, i.e. detecting particles, and a negative image may be obtained by developing this with a positive (negative) toner. A heretofore known method is applied to the developing unit, and a heretofore known method is used for a discharging unit as well.

Although it is not shown in the figure, the image forming apparatus of the present invention may include a mechanism which applies a lubricant to the surface of the latent electrostatic image bearing member. Recently, a spherical toner is considered advantageous for enhancing the image quality of electrophotography and has been in practical use. However, it is known that the blade cleaning of the spherical toner is difficult compared to a conventional ground toner. Therefore, measures have been taken such as increasing the contact pressure of the cleaning blade and using a urethane rubber blade with larger hardness.

These methods are prone to increasing the hazard with respect to the surface of the latent electrostatic image bearing member with which the blade directly contacts, and in fact, it has become clear that there is a tendency that the surface abrasion of the latent electrostatic image bearing member increases with a spherical toner. The latent electrostatic image bearing member of the present invention has very high abrasion resistance, and abrasion of the protective layer rarely occurs even under a highly hazardous condition described above. However, there are occasions of blade noises and abrasion of the blade edge presumably caused by the high coefficient of friction against the cleaning blade Thus, by providing a lubricant coating unit which applies a lubricant to the surface of the latent electrostatic image bearing member to an image forming apparatus of the present invention, the coefficient of friction on the surface of the latent electrostatic image bearing member is reduced with respect to the cleaning blade over a long period of time, and an image forming apparatus and an image forming method with which the above deficiencies are resolved may be obtained.

Figure 7:
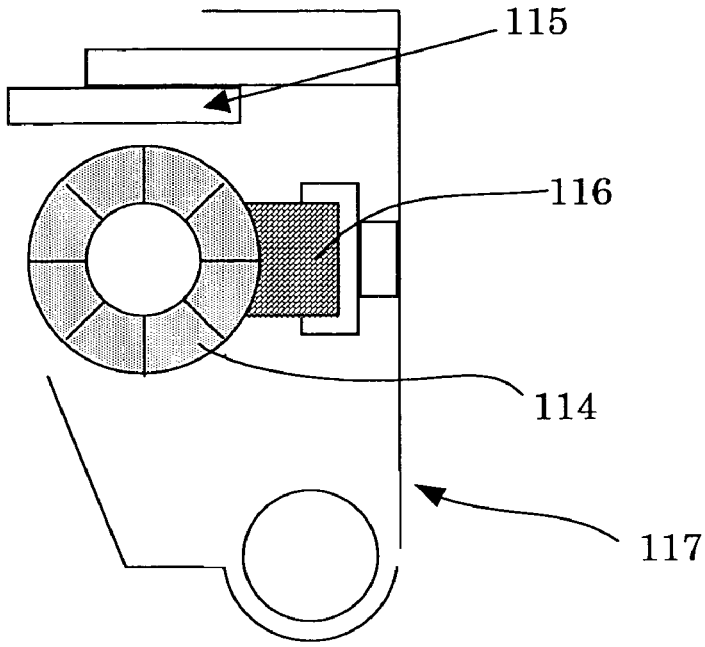
FIG. 7 is a schematic configuration diagram schematically showing an example of a lubricant coating mechanism used for an image forming apparatus of the present invention.

In FIG. 7, a solid material that a lubricant 116 is made into a rod shape is pressed against a cleaning brush 114. The cleaning brush 114 scrapes the lubricant as it rotates, and the lubricant stuck on the brush is applied to the surface of the photoconductor. The lubricant is not necessarily a solid, and it may be applied to the surface of the latent electrostatic image bearing member as a liquid, a powder or in a half boiling state. It is not particularly restricted as long as it satisfies the electrophotographic properties, and it can be appropriately selected according to applications.

Examples of the lubricant includes metal soaps such as zinc stearate, barium stearate, aluminum stearate and calcium stearate; waxes such as carnauba, lanoline and haze wax; and lubricating oil such as silicone oil. Among these, zinc stearate, aluminum stearate and calcium stearate in terms of relatively easy processing into a rod shape and high lubricating effect.

A lubricant coating unit shown in FIG. 7 and provided in a cleaning unit 117 facilitates the layout design around the drum and simplifies the apparatus, but there are occasions that the contamination of a large quantity of the lubricant in a cleaned toner makes it difficult to recycle the toner or reduces the cleaning efficiency of the brush. Although it is not shown in the figure, the above difficulties may be resolved by providing a coating unit including a lubricant coating unit independently and separately from a cleaning unit. Furthermore, by providing several coating units and operating them simultaneously or in sequence, the efficiency of coating the lubricant may be enhanced, or the amount of consumption may be controlled.

Figure 8:
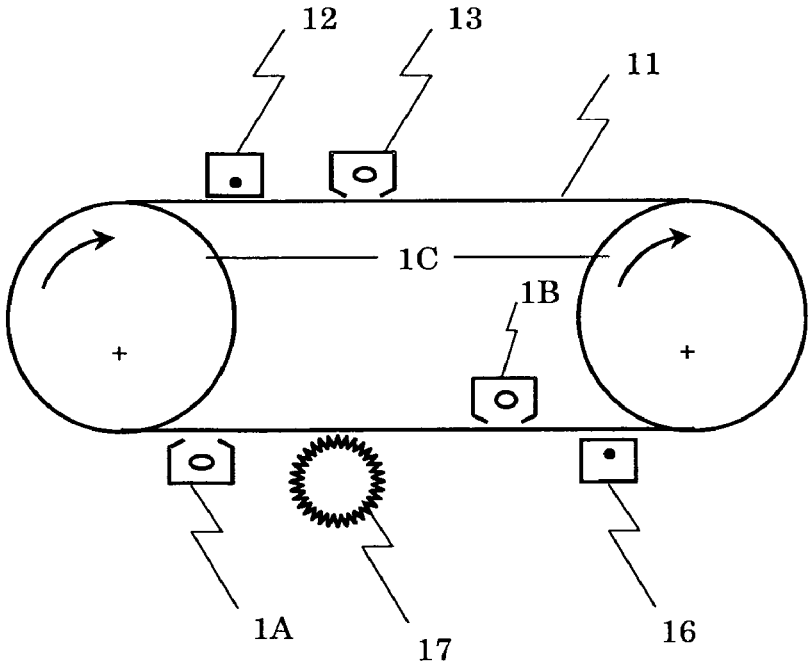
FIG. 8 is a diagram illustrating an electrophotographic process which uses another example of an image forming apparatus of the present invention.

Next, FIG. 8 is another example of an electrophotographic process which uses the image forming apparatus of the present invention. In FIG. 8, a latent electrophotographic image bearing member, i.e. photoconductor, 11 includes at least a charge generating material and a charge transport material and the photoconductor has the self-repairing function on its surface. The photoconductor 11 is shown in a shape of a belt, and it may be in a shape of a drum, sheet or endless belt.

The photoconductor 11 is driven by a driving unit 1C, and a series of electrification with a charging unit 12, image exposure with an exposing unit 13, development (not shown), transfer with a transferring unit 16, pre-cleaning exposure with a pre-cleaning exposing unit, cleaning with cleaning unit 17 and discharge with a discharging unit 1A is repeatedly performed. In FIG. 8, a light is irradiated for the pre-cleaning exposure from the side of the support of the photoconductor, where the support is transparent.

The above electrophotographic process is simply one illustrative embodiment of the present invention, and other embodiments are certainly possible. For example, the pre-cleaning exposure is performed from the side of the support in FIG. 8, but this may be performed from the side of the photoconductive layer. Also, the light for image exposure and discharge may be irradiated from the side of the support. Regarding the light irradiation process, the figure shows the lights for image exposure, pre-cleaning exposure and discharge exposure, and pre-transfer exposure, pre-exposure of the image exposure and other heretofore known light irradiating processes may be additionally provided for the irradiation of the photoconductor.

In addition, the above image forming unit may be fixedly assembled inside a copying machine, facsimile and printer, but it may be assembled in the apparatuses in the form of a process cartridge.

Figure 9:
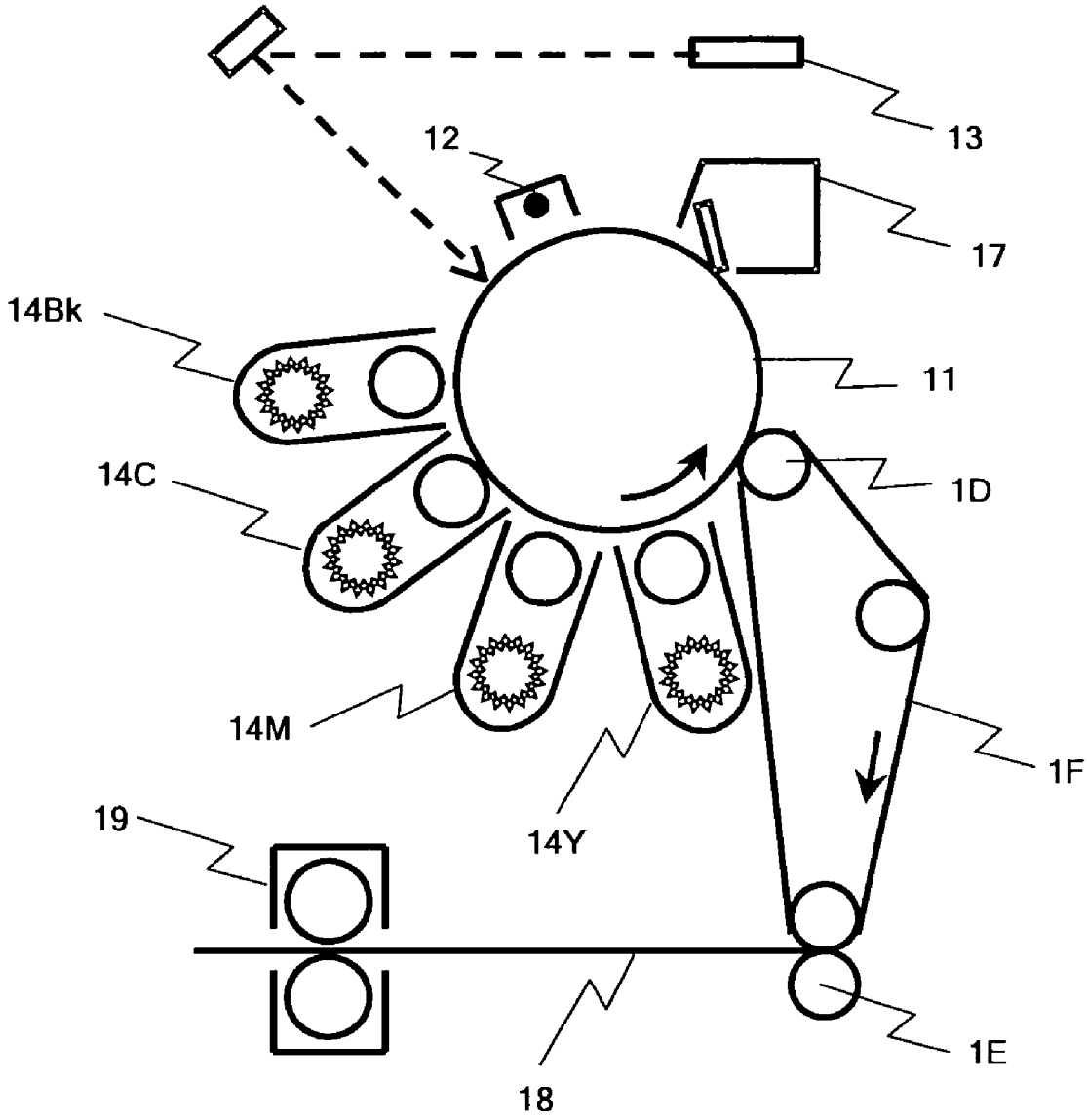
FIG. 9 is a schematic diagram showing yet another example of an image is forming apparatus of the present invention.

FIG. 9 shows another example of an image forming apparatus of the present invention. Around a latent electrostatic image bearing member, i.e. photoconductor, 11 of this image forming apparatus, a charging unit 12, an exposing unit 13, developing units 14Bk, 14C, 14M and 14Y for toners of the respective colors, black (Bk), cyan (C), magenta (M) and yellow (Y), an intermediate transfer belt 1F as an intermediate transfer body and a cleaning unit 17 are arranged in this order.

Here, the subscripts Bk, C, M and Y shown in FIG. 9 correspond to the colors of the toner, and they are shown as a subscript or omitted accordingly. The latent electrostatic image bearing member, i.e. photoconductor, 11 includes at least a charge generating material and a charge transport material, and the latent electrostatic image bearing member has the self-repairing function on its surface. The developing units 14Bk, 14C, 14M and 14Y for respective colors may be controlled independently, and only a developing unit of the color required for image formation is driven.

A toner image formed on the photoconductor 11 is transferred to the intermediate transfer by a first transferring unit 1D arranged inside the intermediate transfer belt 1F. The first transferring unit 1D is provided such that it can be arranged in a contact or non-contact manner. A toner image that an image of each color is sequentially formed and superimposed on the intermediate transfer belt 1F is collectively transferred to a recording medium 18 and then fixed with a fixing unit, and an image is formed. A second transferring unit 1E is also provided such that it can be arranged in a contact or non-contact manner, and it contacts with the intermediate transfer belt 1F only in a fixing operation.

In a transfer drum-type electrophotographic apparatus, there is a restriction that thick rigid paper is not appropriate for printing since a toner image of each color is sequentially transferred to a recording medium which is electrostatically adsorbed to a transfer drum. However, an intermediate transfer-type electrophotographic apparatus shown in FIG. 9 does not have such restriction since a toner image of each color is superimposed on an intermediate transfer body 1F.

Figure 10:
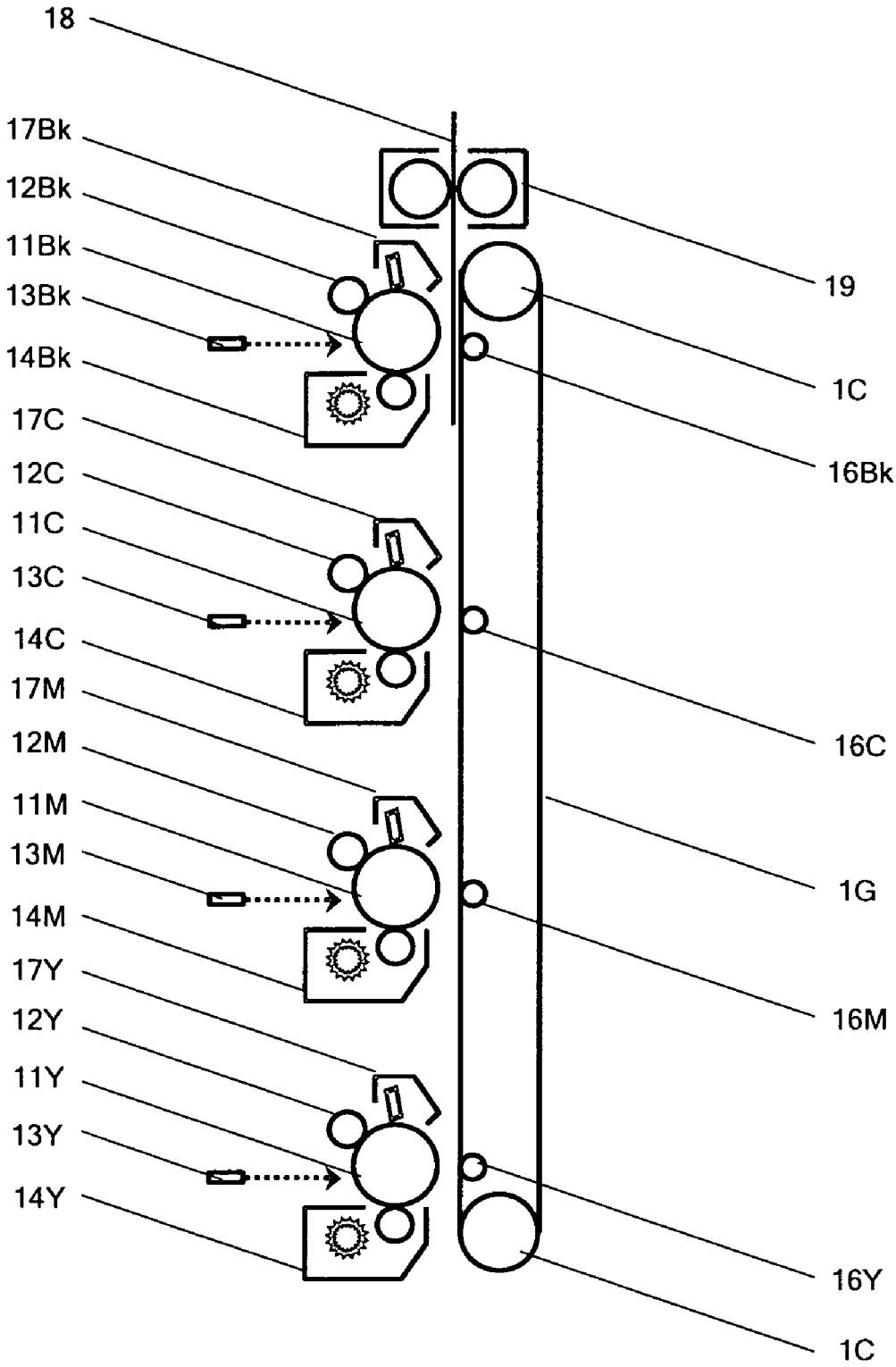
FIG. 10 is a schematic diagram showing yet another example of an image forming apparatus of the present invention.

FIG. 10 is another example of an image forming apparatus of the present invention. This image forming apparatus uses four colors, yellow (Y), magenta (M), cyan (C) and black (Bk) as a toner, and image forming parts are provided for respective colors. Also, a latent electrostatic image bearing members, i.e. photoconductors, 11Y, 11M, 11C and 11Bk are provided for respective colors.

A photoconductor 11 includes at least a charge generating material and a charge transport material, and the surface of the latent electrostatic image bearing member has the self-repairing function. Around the respective photoconductors 11Y, 11M, 11C and 11Bk, a charging unit 12, an exposing unit 13, a developing unit 14 and a cleaning unit 17 are arranged. Also, a transport and transfer belt 1G is spanned with driving units 1C as a recording medium bearing member which is arranged in a contact or non-contact manner at a transfer position of each photoconductor 11Y, 11M, 11C and 11Bk arranged on a straight line. The transferring units 16 are arranged at the opposite transfer position across this transport and transfer belt 1G from the respective photoconductors 1Y, 1M, 1C and 1Bk.

A tandem image forming apparatus shown in FIG. 10 is equipped with photoconductors 1Y, 1M, 1C and 1Bk for respective colors, and a toner image of each color is sequentially transferred to a recording medium maintained by a transport and transfer belt 1G. Therefore, a full color image may be printed considerably faster compared to a fill-color image forming apparatus with only one photoconductor.

The image forming apparatus described above is equipped with a latent electrostatic image bearing member of the present invention which has self-repairing function, and scratches which once used to be caused by the adhesion of a developer carrier to the surface of the photoconductor may be suppressed. Therefore, the apparatus may be loaded with a developer carrier having a small particle diameter with high degree of this adhesion. This is more specifically a developer carrier having a particle diameter of less than 5 μm. It thus becomes possible that the output image has a considerably high resolution.

(Process Cartridge)

A process cartridge of the present invention includes at least a latent electrostatic image bearing member of the present invention and at least any one unit selected from the charging unit, developing unit, transferring unit, cleaning unit and discharging unit, and it further includes other units according to requirements. It is detachably attached to the image forming apparatus body.

The developing unit includes at least: a developer container which contains the toner or the developer, and a developer bearing member which bears and transports the toner or the developer contained in the developer container, and it may further include a layer thickness regulating member for regulates the layer thickness of the toner.

Figure 11:
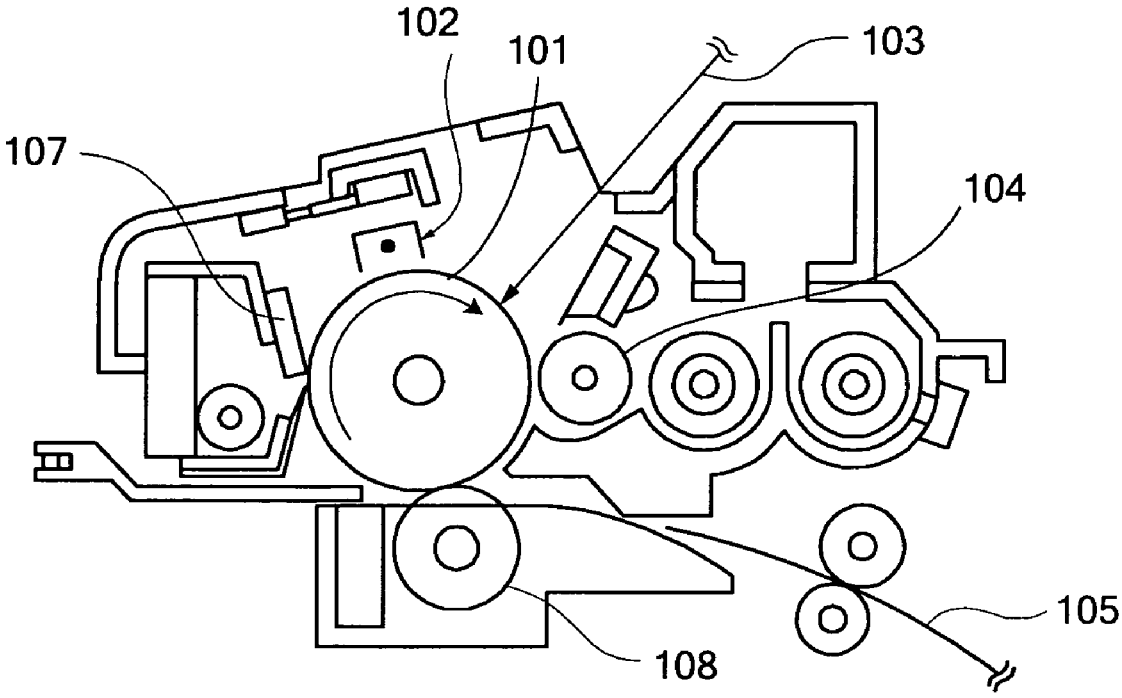
FIG. 11 is a schematic diagram showing an example of a process cartridge of the present invention.

The process cartridge, for example as shown in FIG. 11, houses a photoconductor 101. It also includes at least any one selected from a charging unit 102, a developing unit 104, a transferring unit 106, a cleaning unit 107 and a disc g unit (not shown), and it is an apparatus which can be detachably attached to the image forming apparatus body.

An image forming process by means of the process cartridge shown in FIG. 11 is illustrated. A latent electrostatic image corresponding to an exposure image is formed on the surface of the photoconductor 101, which is rotating in the direction of the arrow, by the charge from the chain unit 102 and exposure 103 from an exposing unit (not shown). This latent electrostatic image is toner developed in the developing unit 104, and the toner development is transferred to the recording medium 105 by the transferring unit 106. Next, the photoconductor surface after the image transfer is cleaned with the cleaning unit 107 and further discharged by a discharge unit (not shown). The above operations are repeated again.

Regarding the image forming apparatus of the present invention, components such as latent electrostatic image bearing member, developing device and cleaning device are integrated to form a process cartridge, and this unit may be detachably attached to the apparatus body. Also, at least any one of the charging device, the image exposing device, the developing device, the transferring or separating device and the cleaning device is supported with the latent electrostatic image bearing member to form the process cartridge as a single unit which can be detachably attached to the apparatus body, and the unit may have a detachable configuration by a guiding means such as rail on the apparatus body.

This allows an easy exchange of the latent electrostatic image bearing member and other process members in a short period of time, and the time required for maintenance may be shortened, and the cost is reduced. Also, the latent electrostatic image bearing member and the other process members as a unit is advantageous since the accuracy of the relative positioning improves.

The present invention is illustrated in detail with reference to examples given below, but these are not to be construed as limiting the present invention. In the following examples, all parts and percentages are by mass unless otherwise specified.

EXAMPLE 1

On an aluminum drum having a wall thickness of 0.8 mm and a diameter of 100 mm, a coating solution for an undercoat layer having the following composition was applied and dried to form an undercoat layer having a thickness of 3.5 μm.

| [Coating solution for undercoat layer] | |
|---|---|
| Alkyd resin (BECKOSOL 1307-60-EL manufactured by Dainippon Ink and Chemicals, Incorporated) | 10 parts |

-continued

| [Coating solution for undercoat layer] | |
|---|---|
| Melamine resin (SUPER BECKAMINE G-821-60 manufactured by Dainippon Ink and Chemicals, Incorporated) | 7 parts |
| Titanium oxide (CR-EL manufactured by Ishihara Sangyo Co., Ltd): | 40 parts |
| Methyl ethyl ketone: | 200 parts |

Next, to the undercoat layer, a coating solution for a charge generating layer having the following composition was applied and dried to form a charge generating layer having a thickness of 0.2 μm.

| [Coating solution for charge generating layer] | |
|---|---|
| Titanyl phthalocyanine (manufactured by Ricoh Company, Ltd.) | 20 parts |
| Polyvinyl alcohol (S-LEC B BX-1 manufactured by Sekisui Chemical Co., Ltd.) | 10 parts |
| Methyl ethyl ketone | 100 parts |

Next, to the charge generating layer, a coating solution for a charge transport layer having the following composition was applied and dried to form a charge transport layer having a thickness of 18 μm.

| [Coating solution for charge transport layer] | |
|---|---|
| Polycarbonate resin (Panlite TS-2050 manufactured by Teijin Chemicals, Ltd.): | 7 parts |
| Low-molecular charge transport material represented by the following structural formula: | 10 parts |

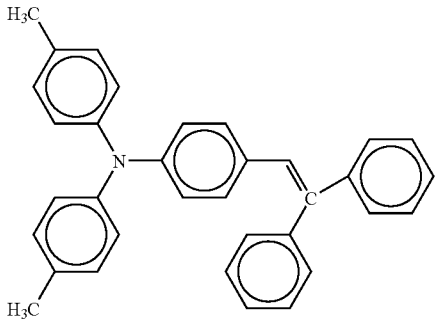

| | |
|---|---|
| Tetrahydrofuran | 79 parts |
| 1% Tetrahydrofuran solution of silicone oil (KF50-100CS manufactured by Shin-etsu Chemical Co., Ltd.): | 1 part |

Next, to the charge transport layer, a coating solution for a surface layer having the following composition was applied with a ring coater and then cured to form a surface layer having a thickness of 5 μm. The surface layer was cured at a temperature of 150° C. for 30 minutes. Thus, a latent electrostatic image bearing member was prepared.

| [Coating solution for surface layer] | |
|---|---|
| Self-repairing resin as a base resin (Self-repairing CLEAR No. 100 manufactured by Natoco Co., Ltd.) | 2 parts |

-continued

| [Coating solution for surface layer] | |
|---|---|
| Self-repairing resin as a curing agent (Self-repairing CLEAR No. 2 manufactured by Natoco Co., Ltd.) | 1 part |
| Methyl isobutyl ketone | 17 parts |

EXAMPLE 2

A latent electrostatic image bearing member of Example 2 was prepared in the same manner as Example 1 except that the methyl isobutyl ketone used for the coating solution for a surface layer in Example 1 was replaced by ethyl cellosolve.

EXAMPLE 3

A latent electrostatic image bearing member of Example 3 was prepared in the same manner as Example 1 except that the thickness of the undercoat layer was changed to 2 μm and that the thickness of the charge transport layer was changed to 30 μm.

EXAMPLE 4

A latent electrostatic image bearing member of Example 4 was prepared in the same manner as Example 1 except that the coating solution for a charge transport layer in Example 1 was replaced by the following.

| [Coating solution for charge transport layer] | |
|---|---|
| Polymeric charge transport material represented by the structural formula below with mass average molecular weight of 100,000 | 12 parts |

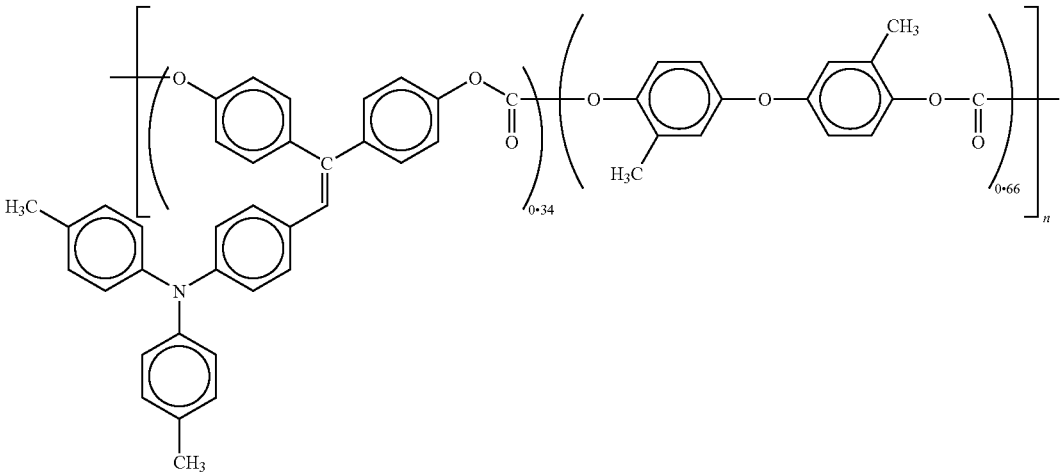

| | |
|---|---|
| Tetrahydrofuran | 87 parts |
| 1% Tetrahydrofuran solution of silicone oil (KF50-100CS manufactured by Shin-etsu Chemical Co., Ltd.): | 1 part |

EXAMPLE 5

A latent electrostatic image bearing member of Example 5 was prepared in the same manner as Example 1 except that the coating solution for a surface layer in Example 1 was replaced by the following.

| [Coating solution for surface layer] | |
|---|---|
| Self-repairing resin as a base resin (Self-repairing CLEAR No. 100 manufactured by Natoco Co., Ltd.) | 19 parts |
| Self-repairing resin as a curing agent (Self-repairing CLEAR No. 2 manufactured by Natoco Co., Ltd.) | 51 part |

-continued

| [Coating solution for surface layer] | |
|---|---|
| Cross-linking charge transport material represented by the structural formula below | 30 parts |

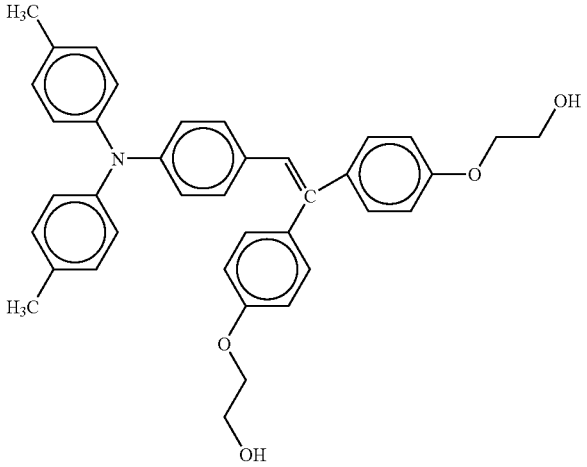

| | |
|---|---|
| Ethyl cellosolve | 900 parts |

EXAMPLE 6

A latent electrostatic image bearing member of Example 6 was prepared in the same manner as Example 1 except that the coating solution for a surface layer in Example 1 was replaced by the following.

| [Coating solution for surface layer] | |
|---|---|
| Self-repairing resin as a base resin (Self-repairing CLEAR No. 100 manufactured by Natoco Co., Ltd.) | 6 parts |
| Self-repairing resin as a curing agent (Self-repairing CLEAR No. 2 manufactured by Natoco Co., Ltd.) | 29 parts |
| Cross-linking charge transport material represented by the structural formula below | 15 parts |

-continued

| [Coating solution for surface layer] | |
|---|---|

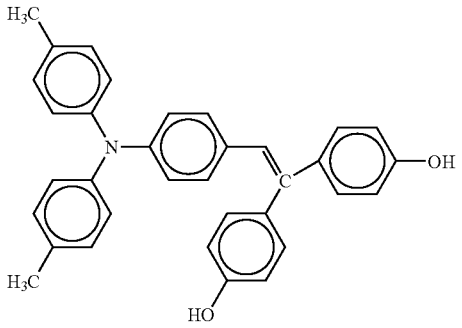

| | |
|---|---|
| Ethyl cellosolve | 450 parts |

EXAMPLE 7

A latent electrostatic image bearing member of Example 7 was prepared in the same manner as Example 1 except that the coating solution for a surface layer in Example 1 was replaced by the following.

| [Coating solution for surface layer] | |
|---|---|
| Self-repairing resin as a base resin (Self-repairing CLEAR No. 100 manufactured by Natoco Co., Ltd.) | 6 parts |
| Curing Agent (SUPER BECKAMINE L-145-60 manufactured by Dainippon Ink and Chemicals, Incorporated) | 3 parts |
| Cross-linking charge transport material represented by the structural formula below | 1 part |

-continued

| [Coating solution for surface layer] | |
|---|---|
| 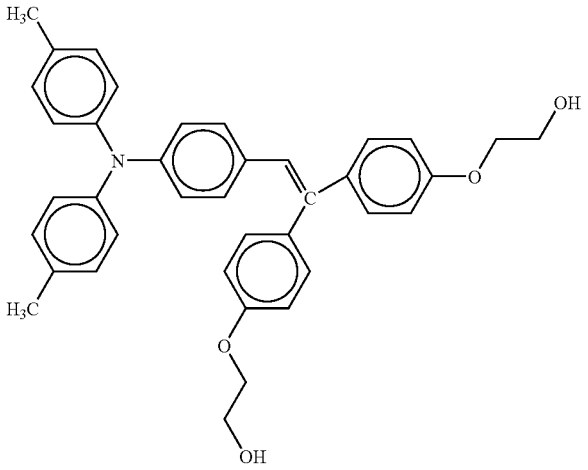 | |
| Methyl isobutyl ketone | 17 parts |

EXAMPLE 8

A latent electrostatic image bearing member of Example 8 was prepared in the same manner as Example 7 except that the cross-linking charge transport material in Example 7 was replaced by the following.

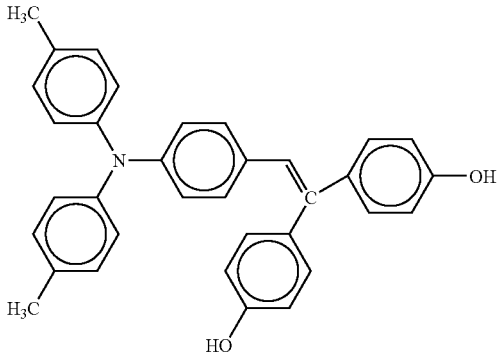

EXAMPLE 9

A latent electrostatic image bearing member of Example 9 was prepared in the same manner as Example 1 except that the coating solution for a surface layer in Example 1 was replaced by the following.

| [Coating solution for surface layer] | |
|---|---|
| Self-repairing resin as a base resin (Self-repairing CLEAR No. 100 manufactured by Natoco Co., Ltd.) | 2 parts |
| Self-repairing resin as a curing agent (Self-repairing CLEAR No. 2 manufactured by Natoco Co., Ltd.) | 1 part |
| Tin-antimony oxide (T-1 manufactured by Mitsubishi Materials Corporation) | 2 parts |
| Ethyl cellosolve | 900 parts |

COMPARATIVE EXAMPLE 1

A latent electrostatic image bearing member of Comparative Example 1 was prepared in the same manner as Example 1 except that the thickness of the charge transport layer was changed to 30 μm and that the surface layer was not provided.

COMPARATIVE EXAMPLE 2

A latent electrostatic image bearing member of Comparative Example 2 was prepared in the same manner as Example 1 except that the coating solution for a surface layer in Example 1 was replaced by the following.

| [Coating solution for surface layer] | |
|---|---|
| Polycarbonate resin (Panlite TS-2050 manufactured by Teijin Chemicals, Ltd.): | 7 parts |
| Low-molecular charge transport material represented by the following structural formula: | 5 parts |
| 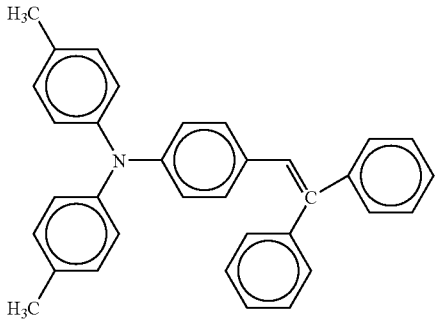 | |
| α-Alumina (SUMICORUNDUMAA-02 manufactured by Sumitomo Chemical Co., Ltd.): | 3 parts |
| Specific resistance reducing agent (BYK-P104 manufactured by BYK-Chemie GmbH) | 0.1 parts |
| Cyclohexanone | 80 parts |
| Tetrahydrofuran | 280 parts |

<Abrasion Resistance Test>

For each of the obtained latent electrostatic image bearing members of Examples 1 to 9 and Comparative Examples 1 to 2, a film having the same composition as its surface layer was formed on a slide glass such that the film had a thickness of 5 μm, and the haze value was measured with a haze meter after rubbing the film with a steel wool of #000 and a load of 500 gf for 50 times. The results are shown in Table 1.

<Image Forming Test>

The obtained latent electrostatic image bearing members of Examples 1 to 9 and Comparative Examples 1 to 2 were arranged for implementation and mounted on a high-speed image forming apparatus (imagio Neo 1050 Pro manufactured by Ricoh Company, Limited) which had been remodeled such that the process time for the image exposure portion of a latent electrostatic image bearing member to reach the sleeve portion of a developing unit was 95 msec. Then, a pattern of text and graphic image having a pixel density of 600 dpi×600 dpi and an image density of 6% was printed in total on 300,000 sheets of copy paper (MY PAPER manufactured by Ricoh Company, Limited), provided that one pattern was printed consecutively on 999 sheets.

The toner used here was a genuine product, and the developer was changed to the one having an average carrier particle diameter of 20 μm from a genuine product. A scorotron charger assembled to the apparatus was used directly as the charging unit of the image forming apparatus. The circuit which controls the processing state of the image forming apparatus, i.e. process control was activated while testing. The test environment had a temperature of 24° C. and a relative humidity of 54%.

After the image forming test was completed, the surface roughness, abrasion loss, electric potential at an exposed area of the latent electrostatic image bearing members and dissolution were evaluated as follows. The results are shown in Table 1.

(1) Measurement of Surface Roughness of Latent Electrostatic Image Bearing Member After the image forming test, a value of ten-point height of irregularities, Rz, was measured in compliance with JIS B0601-1994 with a stylus surface texture measuring instrument (Surfcom manufactured by Tokyo Seimitsu Co., Ltd.) equipped with a pickup (E-DT-S02A manufactured by Tokyo Seimitsu Co., Ltd.) on the surface of each latent electrostatic image bearing member.

(2) Measurement of Thickness of Photoconductive Layer

After the image forming test, the thickness of each latent electrostatic image bearing member was measured at every 1 cm in the longer direction of the drum with an eddy-current thickness measuring instrument (FISCHERSCOPE MMS, manufactured by Fischer Instruments K.K., and the average value thereof was recorded as the thickness of the photoconductor.

(3) Measurement of Surface Potential of Latent Electrostatic Image Bearing Member After the image forming test, a remodeled developing unit equipped with a probe of a surface potentiometer (Trek MODEL 344 manufactured by Trek, Inc.) was assembled at the developing unit in the image forming apparatus, and the surface potential at the center section of each latent electrostatic image bearing member was measured.

(4) Measurement of Dissolution

After the image forming test, a resolution chart was photocopied under the developing conditions that the pixel density was 600 dpi×600 dpi and that the image density of solid patch was 0.8, and the maximum resolution was measured.

TABLE 1

| | Abrasion Resistance Haze (%) | Surface Roughness Rz (μm) | Abrasion Loss (μm) | Potential at Exposed Area (−V) | Resolution (mm/line) |
|---|---|---|---|---|---|
| Example 1 | 0.4 | 0.4 | 0.4 | 170 | 8 |
| Example 2 | 0.4 | 0.6 | 0.2 | 140 | 9 |
| Example 3 | 0.4 | 0.6 | 0.2 | 120 | 10 |
| Example 4 | 0.4 | 0.6 | 0.2 | 120 | 10 |
| Example 5 | 0.5 | 0.5 | 0.3 | 130 | 9 |
| Example 6 | 0.5 | 0.4 | 0.3 | 140 | 9 |
| Example 7 | 0.5 | 0.4 | 0.3 | 120 | 10 |
| Example 8 | 0.5 | 0.4 | 0.3 | 130 | 9 |
| Example 9 | 6.0 | 0.6 | 0.5 | 120 | 8 |
| Comparative Example 1 | 19.0 | 1.0 | 8.0 | 110 | 9 |
| Comparative Example 2 | 22.0 | 1.9 | 1.0 | 120 | 8 |

The results in Table 1 indicate that the surface layer of Examples 1 to 8 had exceptional abrasion resistance compared to the surface layer of Comparative Examples 1 to 2. In addition, the surface layer of Example 9 had superior abrasion resistance compared to the surface layer of Comparative Examples 1 to 2. These properties indicate the possibility of easy exchange of a photoconductor by an average user and simplification of packaging materials.

This is indicated also by the surface roughness after the test. The latent electrostatic image bearing members of Examples 1 to 9 maintained the smooth surface and had the superior abrasion resistance as well, therefore, they may be judged as a latent electrostatic image bearing member having exceptional mechanical durability. On the other hand, the latent electrostatic image bearing members of Comparative Examples 1 and 2 show signs that developer carrier particles were embedded in the surface of the photoconductor, which resulted in high surface roughness.

Regarding the electric potential at an exposed area, the latent electrostatic image bearing member of Examples 2 to 9 all ensured a low value compared to that of Example 1. This is presumably because the solubility of the surface layer with respect to the lower layer was suppressed (Examples 2 and 4), because the thickness of the photoconductive layer was adjusted for high sensitivity (Example 3), because the charge transport segment was introduced to the surface layer (Examples 5 to 8), and because the conductive filler was added to the surface layer (Example 9). Since the developer had a carrier having a small particle diameter, the resolution of a printed image was all high, and the latent electrostatic image bearing members of Examples 1 to 9 achieved a resolution equivalent or greater than that of Comparative Example 1. Here, it is considered that the superiority in abrasion resistance contributes to not only the durability but also the high image quality of the image forming apparatus.

INDUSTRIAL APPLICABILITY

The latent electrostatic image bearing member of the present invention is superior in terms of the abrasion resistance and mechanical strength. Therefore, the packaging materials used for preventing scratches of the latent electrostatic image bearing member may be simplified, and moreover anybody can easily handle the latent electrostatic image bearing member. Since the abnormal image caused by the scratches on the surface may be avoided, the latent electrostatic image bearing member of the present invention may employ a developer with a carrier having a small particle diameter, and a high-quality image may be obtained even after a prolonged use of the image forming apparatus. The image forming apparatus of the present invention may be favorably used for a printer, a facsimile, a photocopier or a complex machine thereof since it can perform a smooth toner delivery in a toner delivery path even during the initial photocopying operations after a prolonged unused period.

What is claimed is:

1. A latent electrostatic image hearing member comprising at least:

a support; a photoconductive layer on the support; and a surface layer on the photoconductive layer, wherein the surface layer comprises a cured material which comprises a polydimethylsiloxane copolymer, polycaprolactone and polysiloxane, the cured material is one of a urethane cross-linked material of a polydimethylsiloxane copolymer, and a melamine cross-linked material of a polydimethylsiloxane copolymer, the surface layer has a haze value of 10% or less, and the haze value is measured by rubbing a film, which has the same composition as the surface layer and has been formed on a slide glass so as to have a thickness of 5 μm, with a steel wool of #000 and a load of 500 gf for 50 times.

2. The latent electrostatic image bearing member according to claim 1, wherein the haze value is 1.0% or less,

3. The latent electrostatic image bearing member according to claim 1, wherein the surface layer comprises a charge transport material represented by Structural Formula (1) below:

Structural Formula (1)

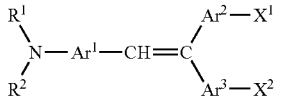

wherein, in Structural Formula (1) above, $R^1$ and $R^2$ are the same or different and represent a substituted or non-substituted aryl group;

$Ar^1$, $Ar^2$ and $Ar^3$ are the same or different and represent a substituted or non-substituted arylene group; and $X^1$ and $X^2$ are the same or different and represent any one of a hydroxyl group and $—O—(CH_2)_p—OH$, wherein p represents an integer of one to 10.

4. The latent electrostatic image hearing member according to claim 3, wherein the content of the charge transport material in the surface layer is 1% by mass to 50% by mass.

5. The latent electrostatic image hearing member according to claim 1, wherein the surface layer comprises a conductive filler.

6. The latent electrostatic image hearing member according to claim 1, wherein the surface layer has a thickness of 1 μm to 10 μm.

7. The latent electrostatic image hearing member according to claim 1, wherein the photoconductive layer is a single-layer photoconductive layer.

8. The latent electrostatic image bearing member according to claim 1, wherein the photoconductive layer is a laminated photoconductive layer which comprises at least a charge generating layer and a charge transport layer.

9. A process cartridge integrally comprising at least any one unit selected from: a latent electrostatic image bearing member, a charging unit, a developing unit, a transferring unit and a cleaning unit, wherein the latent electrostatic image bearing member comprises at least: a support; a photoconductive layer on the support; and a surface layer on tile photoconductive layer, wherein a film having the same composition as the surface layer is formed on a slide glass such that the film has a thickness of 5 μm, and the haze value measured after rubbing the obtained film with a steel wool of #000 and a load of 500 gf for 50 times is 10% or less.

10. An image forming apparatus comprising at least:

a latent electrostatic image bearing member;

a latent electrostatic image forming unit which forms a latent electrostatic image on the latent electrostatic image bearing member;

a developing unit which forms a visible image by developing the latent electrostatic image with a toner;

a transferring unit which transfers the visible image to a recording medium; and a fixing unit which fixes a transferred image transferred to the recording medium, wherein the latent electrostatic image bearing member comprises at least: a support; a photoconductive layer on the support; and a surface layer on the photoconductive layer, wherein a film having the same composition as the surface layer is formed on a slide glass such that the film has a thickness of 5 μm, and the haze value measured after rubbing the obtained film with a steel wool of #000 and a load of 500 gf for 50 times is 10% or less.

11. The image forming apparatus according to claim 10, wherein the image forming apparatus comprises a lubricant coating unit which applies a lubricant to the surface of the latent electrostatic image hearing member.

12. The image forming apparatus according to claim 11, wherein the lubricant is a metal soap.

13. The image forming apparatus according to claim 12, wherein the metal soap is at least any one type selected from: zinc stearate, aluminum stearate and calcium stearate.

14. An image funning method comprising at least:

a latent electrostatic image forming process which forms a latent electrostatic image on a latent electrostatic image bearing member;

a developing process which forms a visible image by developing the latent electrostatic image with a toner;

a transferring process which transfers the visible image to a recording medium; and a fixing process which fixes a transferred image transferred to the recording medium, wherein the latent electrostatic image bearing member comprises at least: a support; a photoconductive layer on the support; and a surface layer on the photoconductive layer, wherein a film having the same composition as the surface layer is formed on a slide glass such that the film has a thickness of 5 μm, and the haze value measured after rubbing the obtained film with a steel wool of #000 and a load of 500 gf for 50 times is 10% or less.

* * * * *